US007246981B2

(12) United States Patent
Parker

(10) Patent No.: US 7,246,981 B2
(45) Date of Patent: Jul. 24, 2007

(54) APPARATUS AND METHOD FOR MAKING HARDCOVER BOOK

(75) Inventor: Kevin P. Parker, Berkeley, CA (US)

(73) Assignee: Powis Parker, Inc., Berkeley, CA (US)

( * ) Notice: Subject to any disclaimer, the term of this patent is extended or adjusted under 35 U.S.C. 154(b) by 187 days.

(21) Appl. No.: 10/674,075

(22) Filed: Sep. 29, 2003

(65) Prior Publication Data

US 2004/0120794 A1 Jun. 24, 2004

(51) Int. Cl.
*B42C 9/00* (2006.01)

(52) U.S. Cl. ..... 412/8; 412/1; 412/4; 412/6; 412/28; 412/33; 412/902; 281/21.1

(58) Field of Classification Search ..... 281/29, 281/21.1, 34; 412/8, 1, 6, 9, 22, 24, 25, 28, 412/33, 900, 902
See application file for complete search history.

(56) References Cited

U.S. PATENT DOCUMENTS

| | | | | |
|---|---|---|---|---|
| 2,294,347 | A | 8/1942 | Bauer | 154/46 |
| 3,080,178 | A | 3/1963 | Brody | 281/34 |
| 3,367,680 | A | 2/1968 | Greenspan | 281/37 |

(Continued)

FOREIGN PATENT DOCUMENTS

| | | | |
|---|---|---|---|
| CA | 991219 | 6/1976 | |
| EP | 0404751 A1 | 12/1990 | |
| JP | 403227698 A | 10/1991 | 312/184 |
| WO | WO 99/39917 | 8/1999 | |

OTHER PUBLICATIONS

Seal and View ®"Clear Label Protectors" Self Adhesive Stock No. CLL manufactured by Smead, Hastings Minnesota. (Admitted Prior Art).

*Primary Examiner*—Monica Carter
*Assistant Examiner*—Eric A. Gates
(74) *Attorney, Agent, or Firm*—Girard & Equitz LLP

(57) ABSTRACT

A method and apparatus for binding a stack of sheets which can be carried out using a conventional perfect binding machine. A stack to be bound is positioned between a pair of end leafs. Molten hot melt adhesive is then applied to the edge of the stack and to the first and second end leafs, preferably using the perfect binding machine. An elongated spine member is then applied to the edge of the stack and is secured by the hot melt adhesive. The elongated spine member is preferably part of a configuration having a form factor that generally matches that of the conventional cover so that configuration, including the spine member, can be applied using the traditional perfect binder machine. The respective edges of the spine member are secured to the outer sheets of the end leafs by way of pressure sensitive adhesives. In one embodiment, the pressure sensitive adhesive is disposed on the edges of the spine member and covered by release sheets. After the spine structure has been secured by the hot melt adhesive, the user folds the edges of the spine structure away from the stack thereby revealing the release sheets. The release sheets are removed thereby exposing the pressure sensitive adhesive segments. The edges of the spine member are then pressed back against the stack causing the edges of the structure to be secured to the respective end leafs by the pressure sensitive adhesive. Preferably, a hardcover is secured using the end leafs and pressure sensitive adhesive.

12 Claims, 24 Drawing Sheets

U.S. PATENT DOCUMENTS 3,532,363 A 10/1970 Abildgaard et al. ..... 281/29
3,608,115 A 9/1971 Chou et al. ..... 412/19
3,715,260 A 2/1973 Dornemann et al. .... 156/477 B
3,749,422 A * 7/1973 Abildgaard et al. ..... 281/21.1
3,816,866 A 6/1974 Miaskoff et al. ..... 11/3
3,825,963 A 7/1974 Abildgaard et al. ..... 412/21
3,847,718 A 11/1974 Watson ..... 161/39
3,912,304 A 10/1975 Abildgaard et al. ..... 281/21.1
3,964,770 A * 6/1976 Abildgaard et al. ..... 281/29
RE29,105 E 1/1977 Miaskoff et al. ..... 11/3
4,126,982 A 11/1978 Ito et al. ..... 53/593
4,129,914 A 12/1978 Jahn ..... 11/2
4,184,218 A * 1/1980 Hawkes ..... 412/8
4,244,069 A * 1/1981 Hale ..... 412/33
4,299,410 A 11/1981 Jukola ..... 281/21 R
4,314,716 A * 2/1982 Errichiello ..... 281/29
4,367,061 A 1/1983 Wilholm ..... 412/3
4,377,430 A 3/1983 Bexley et al. ..... 156/184
4,385,225 A 5/1983 Giulie ..... 219/521
4,420,282 A 12/1983 Axelrod ..... 412/4
4,496,617 A 1/1985 Parker ..... 428/55
4,511,298 A 4/1985 Jones ..... 412/34
4,537,544 A 8/1985 Joost ..... 412/5
4,615,541 A * 10/1986 Kwauka ..... 281/29
4,650,216 A * 3/1987 Carlson ..... 281/34
4,762,341 A 8/1988 Rabuse ..... 281/29
4,800,110 A * 1/1989 DuCorday ..... 428/43
4,898,506 A 2/1990 Lázár ..... 412/8
4,906,156 A 3/1990 Axelrod ..... 412/21
5,011,187 A * 4/1991 Hunder et al. ..... 281/15.1
5,013,200 A 5/1991 Hunder et al. ..... 412/6
5,044,857 A 9/1991 Crudo ..... 412/19
5,052,872 A 10/1991 Hunder et al. ..... 412/6
5,052,873 A 10/1991 Parker et al. ..... 412/13
5,066,183 A * 11/1991 Tholerus ..... 412/4
5,078,563 A 1/1992 Lolli ..... 412/8
5,154,447 A 10/1992 Tooker ..... 281/21.1
5,174,556 A 12/1992 Taylor et al. ..... 270/1.1
5,193,962 A 3/1993 Parker et al. ..... 412/8
5,340,155 A 8/1994 Podosek ..... 281/29
5,346,350 A 9/1994 Luhman et al. ..... 412/37
5,364,215 A 11/1994 Snellman et al. ..... 412/3
5,452,920 A * 9/1995 Parker ..... 281/21.1
5,569,011 A 10/1996 Yamaguchi et al. ..... 412/9
5,601,312 A * 2/1997 Funkhouser ..... 281/21.1
5,601,915 A 2/1997 Ochi et al. ..... 428/323
5,605,425 A * 2/1997 Schaefer ..... 412/4
5,613,711 A * 3/1997 Parker ..... 281/21.1
5,683,111 A 11/1997 Bass et al. ..... 281/21.1
5,727,816 A 3/1998 Ong ..... 281/29
5,779,423 A 7/1998 Bermingham ..... 412/4
5,829,938 A 11/1998 Hartwig et al. ..... 412/8
5,833,423 A 11/1998 Yamuguchi et al. ..... 412/8
5,997,964 A 12/1999 Klima, Jr. ..... 428/1
6,010,157 A 1/2000 Pierson et al. ..... 281/21.1
6,024,525 A 2/2000 Yamanaka ..... 412/36
6,056,493 A 5/2000 Hartwig et al. ..... 412/8
6,065,884 A 5/2000 Parker et al. ..... 400/611
6,155,763 A * 12/2000 Parker et al. ..... 412/6
6,158,776 A 12/2000 Purcocks ..... 281/21.1
6,174,120 B1 1/2001 Kalisher ..... 412/1
6,322,867 B1 11/2001 Rush et al. ..... 428/40.1
6,332,630 B1 12/2001 Wolff et al. ..... 281/29
6,530,339 B1 3/2003 Silverbrook ..... 118/46
6,599,074 B2 7/2003 Parker ..... 412/33
6,619,900 B2 * 9/2003 Cobene et al. ..... 412/1
6,632,060 B1 10/2003 Gilmore et al. ..... 412/9
6,641,345 B2 * 11/2003 Cobene et al. ..... 412/1
6,685,415 B2 2/2004 Rush et al. ..... 412/37
6,709,727 B1 3/2004 Parker ..... 428/40.1
6,739,816 B1 * 5/2004 Schuder et al. ..... 412/4
6,910,842 B1 * 6/2005 Yeaple ..... 412/8
2002/0064437 A1 5/2002 Kuramoto et al.
2004/0066029 A1 4/2004 Parker
2004/0066030 A1 4/2004 Parker
2004/0067123 A1 4/2004 Parker et al.
2004/0120793 A1 6/2004 Parker
2004/0120794 A1 6/2004 Parker
2004/0240965 A1 * 12/2004 Schuder et al. ..... 412/4
2006/0034672 A1 2/2006 VanDeWalle et al.
2006/0083604 A1 4/2006 Parker
2006/0115347 A1 6/2006 Parker
2006/0198719 A1 * 9/2006 Parker et al. ..... 412/4

* cited by examiner

APPARATUS AND METHOD FOR MAKING HARDCOVER BOOK

BACKGROUND OF THE INVENTION

1. Field of the Invention

The present invention is generally related to the field of bookbinding and, in particular, to the binding a stack of sheets into a hardcover book.

2. Description of Related Art

There are several well-known techniques for binding books. One technique, commonly referred to as perfect binding, is used to bind a stack of sheets using a hot melt adhesive. The adhesive is also used to secure a soft cover to the bound stack. Referring to the drawings, the perfect binding process is illustrated in schematic form in FIGS. 1A-1C. This process is typically automated. The stack 30 to be bound is secured in a clamping mechanism illustrated by clamp members 32A and 32B. A grinding mechanism 31 at a first station is used to grind the edge 30A of the stack. This is typically accomplished using high speed rotating cutting blades 31A. The roughened edge of the stack will facilitate the absorption of hot melt adhesive and ensures that each sheet will contact the adhesive.

Next, as illustrated in FIG. 1B, the stack is moved to a further station where hot melt adhesive 34 is applied to the edge of the stack. While the adhesive is still molten, the stack is moved to a third station as shown in FIG. 1C where a folded paper cover 36 is automatically folded around and secured to the stack by way of molten adhesive 34. If needed the stack 30 and/or cover 36 are then trimmed after the adhesive has had an opportunity to cool.

In some applications, a pair of special end leafs are added to the stack 30 prior to binding for the purpose of enhancing the appearance of the bound book. FIG. 2 shows one end leaf 38 that includes a folded sheet of relatively heavy paper that forms sheets 40A and 40B, joined at fold 40C. An elongated, relatively stiff, spacer member 46 is attached to the lower portion of sheet 40A and extends slightly below the fold line 40C, typically ⅛ of an inch. End leaf 38 is positioned adjacent one outer sheet of a stack 30 and a second similar end leaf 42 is positioned adjacent the other outer sheet of stack 30. The dimensions of end leafs 38 and 42, including the respective spacer members 46 and 48, correspond to the dimensions of the sheets to be bound. When the stack and end leafs are subjected to the grinding step previously mentioned in connection with FIG. 1A, a small portion of the end of the stack and much of the spacer members 46 and 47 are ground away. The spacer members 46 and 48 operate as sacrificial elements to prevent sheets 40A, 40B, 44A and 44B and the folds connecting the sheets from being damaged in the grinding step.

Once the cover 36 has been applied to the bound stack, outer sheets 40A and 44A are glued to the respective inner surfaces of the cover. Thus, when the cover is opened at one end, the reader can see, for example, sheets 40B and 40A connected near the spine at fold 40C. When the cover is opened at the other end, sheets 40A, 40B and fold 44C can be seen. Thus, the prefect bound book has the appearance that approaches that of a traditional bound book. Note also that the position of each of end leafs 38 and 42 could be reversed so that spacer members 46 and 48 are positioned on the outside of the assembly rather than being positioned adjacent the respective outer sheets of stack 30. In any event, in this application, the only functioned performed by end leafs 38 and 42 is cosmetic.

The above-described prior art perfect binding method is very popular, particularly for fairly high volume production. It is possible to produce a hardcover book starting with the bound stack or book block 30 produced at the end of the step described in connection with FIG. 1B. A hardcover is applied to the book block 30 using what can be termed a cold glue, as contrasted with the hot melt adhesive used in the perfect binder machine. Unfortunately, there is an interface between the hot melt adhesive and the cold glue that has a tendency to fail over time.

The present invention permits a hardcover book to be produced using conventional perfect binding equipment and related technology. The resultant hardcover book structure avoids the above-mentioned problem resulting from the interface between the hot melt adhesive and cold glue. These and other advantages of the present invention will become apparent to those skilled in the art upon a reading of the following Detailed Description of the Invention together with the drawings.

SUMMARY OF THE INVENTION

A method of binding a stack of sheets which can be carried out using a conventional perfect binder machine is disclosed along with binding apparatus. First and second end leafs are provided, with each end leaf including first and second sheet segments separated by a fold, with each sheet segment having dimensions that generally correspond to dimensions of the sheets of the stack of sheets. The stack of sheets is disposed intermediate the first and second end leafs, with the folds of the end leafs being positioned proximate an edge of the stack to be bound and with the second sheet segments of the first and second end leafs being positioned adjacent the stack.

Molten hot melt adhesive is then applied to the edge of the stack and to the first and second end leafs. This step is preferably carried out using the perfect binder machine. An elongated spine member is then applied to the edge of the stack and is secured by the hot melt adhesive. The elongated spine member is preferably part of a configuration having a form factor that generally matches that of the conventional cover. In one embodiment, a pair of removable release sheets in combination with the spine member provide the configuration form factor. Thus, the configuration, including the spine member, can be applied to the stack using the traditional perfect binder machine.

The spine member will typically be wrapped around the edge of the stack, but will be secured to the stack only in the region where the spine member abuts the stack edge. The respective edges of the spine member are secured to the outer sheets of the end leafs by way of pressure sensitive adhesives. In one embodiment, the pressure sensitive adhesive is disposed on the edges of the spine member and covered by release sheets. The release sheets together with the spine member itself provides the appropriate form factor so that the configuration can be applied by the perfect binder machine. After the spine structure has been secured by the hot melt adhesive, the user folds the edges of the spine structure away from the stack thereby revealing the release sheets. The release sheets are removed thereby exposing the pressure sensitive adhesive segments. The edges of the spine member are then pressed back against the stack causing the edges of the structure to be secured to the respective end leafs. Preferably, a hardcover is secured using the end leafs and pressure sensitive adhesive.

DETAILED DESCRIPTION OF THE INVENTION

Figure 1A:
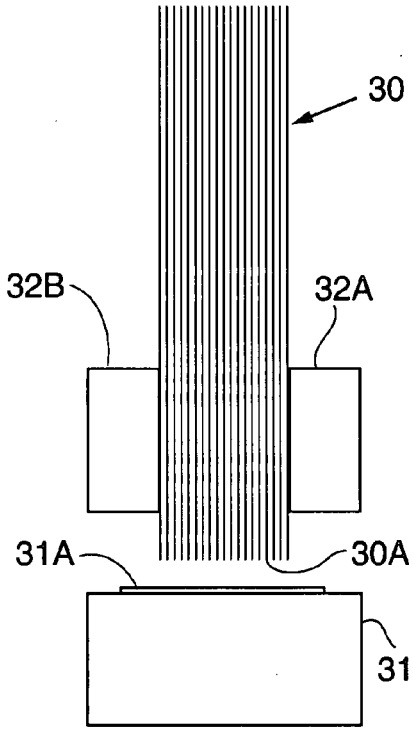
FIG. 1A (PRIOR ART)
FIGS. 1A, 1B and 1C depict the steps carried out using the prior art perfect binder method.
Figure 1B:
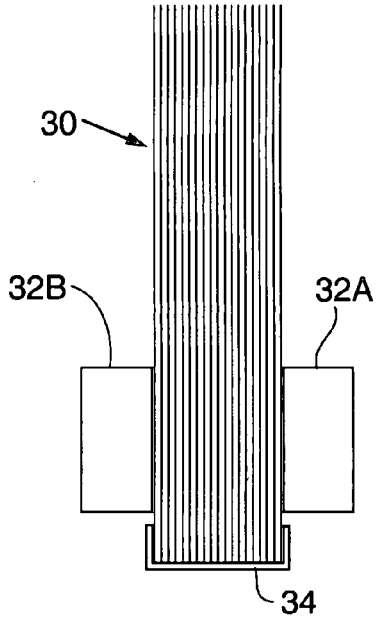
FIG. 1B (PRIOR ART)
Figure 1C:
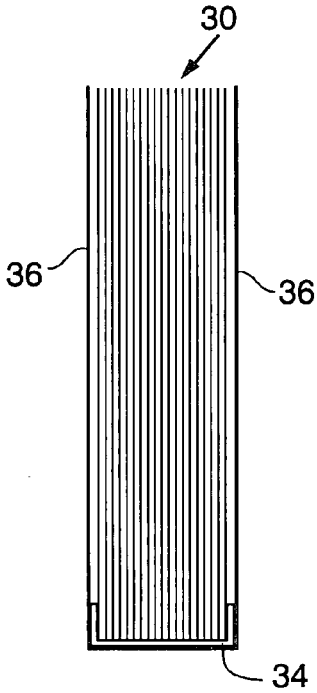
FIG. 1C (PRIOR ART)
Figure 2A:
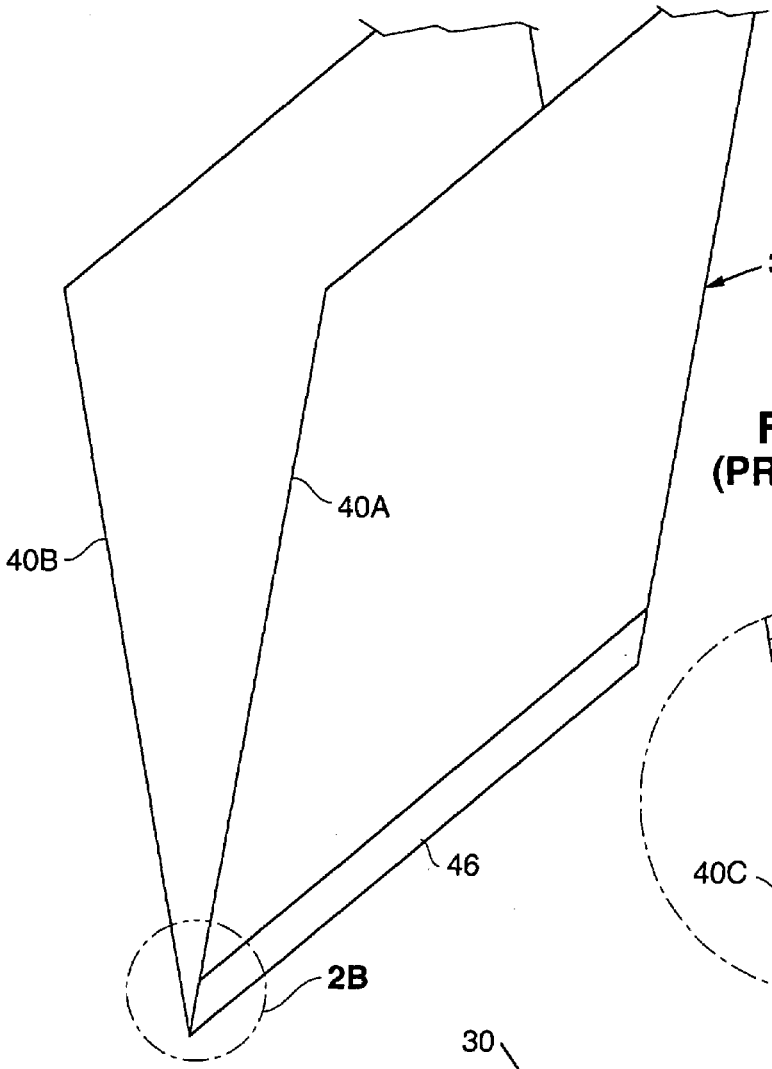
FIG. 2A (PRIOR ART)
FIGS. 2A and 2B are perspective and expanded view of a prior end leaf sometimes used in the perfect binder method.
Figure 2B:
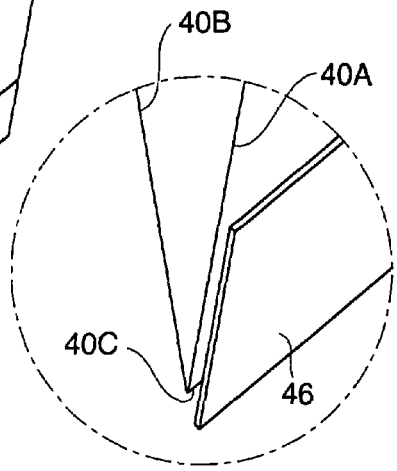
FIG. 2B (PRIOR ART)
Figure 3:
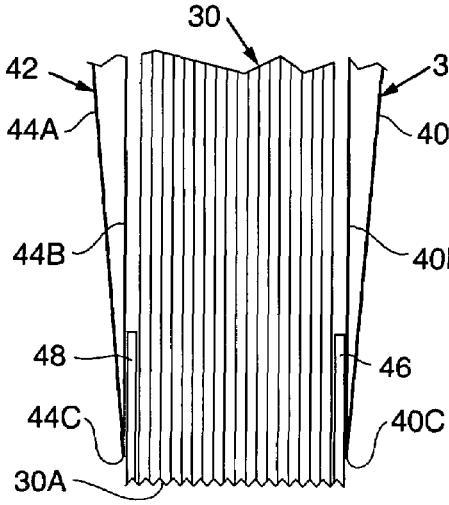
FIG. 3 (PRIOR ART)
FIG. 3 is a partial elevational view of a stack after the grinding step of the prior art perfect binder procedure and prior to the application of hop melt adhesive.
Figure 4:
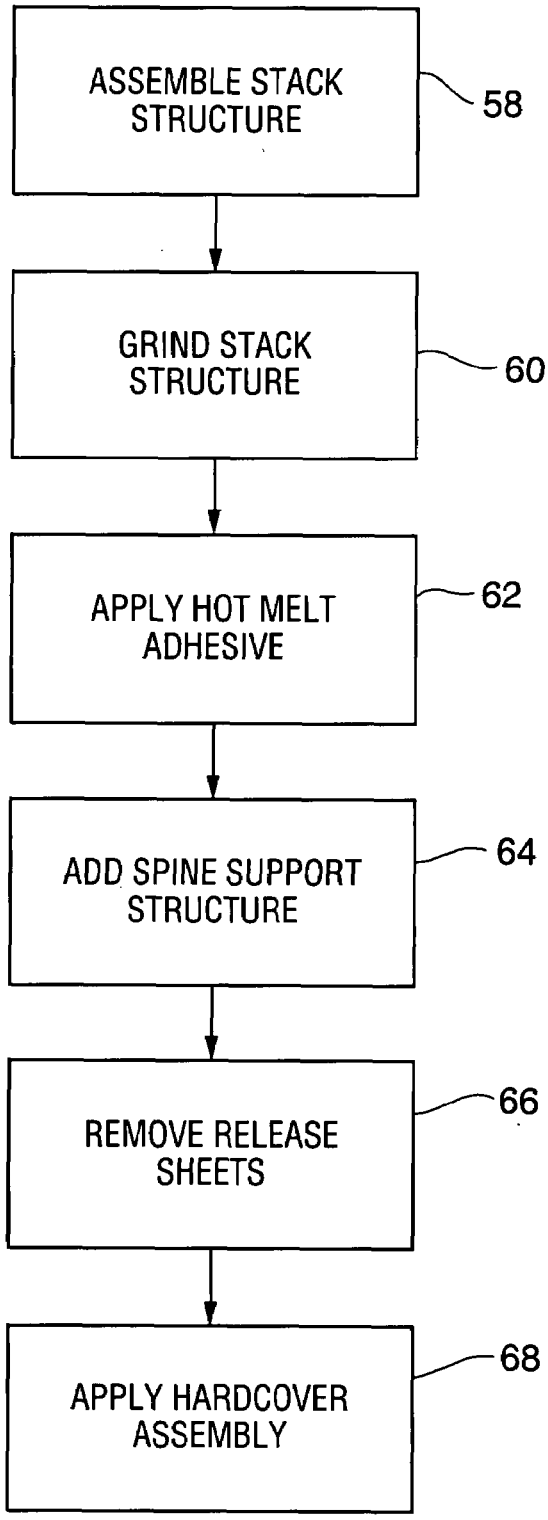
FIG. 4 is a flow chart of one embodiment of the present invention.

Referring again to the drawings, FIGS. 4 is a simplified flow chart showing the manner in one embodiment of the present invention is carried out. In the first step, the stack to be bound is assembled together with a pair of end leafs similar to end leafs 38 and 42 of FIGS. 2A, 2B and 3. This step is represented by element 58 of the flow chart. Next, as represented by element 60, the assembly is placed in a conventional perfect binder machine where the edge of the stack is ground, resulting in a structure similar to that depicted in FIG. 3. Next, perfect binder is used to apply hot adhesive to the ground edge of the stack as indicated by element 62.

Figure 5:
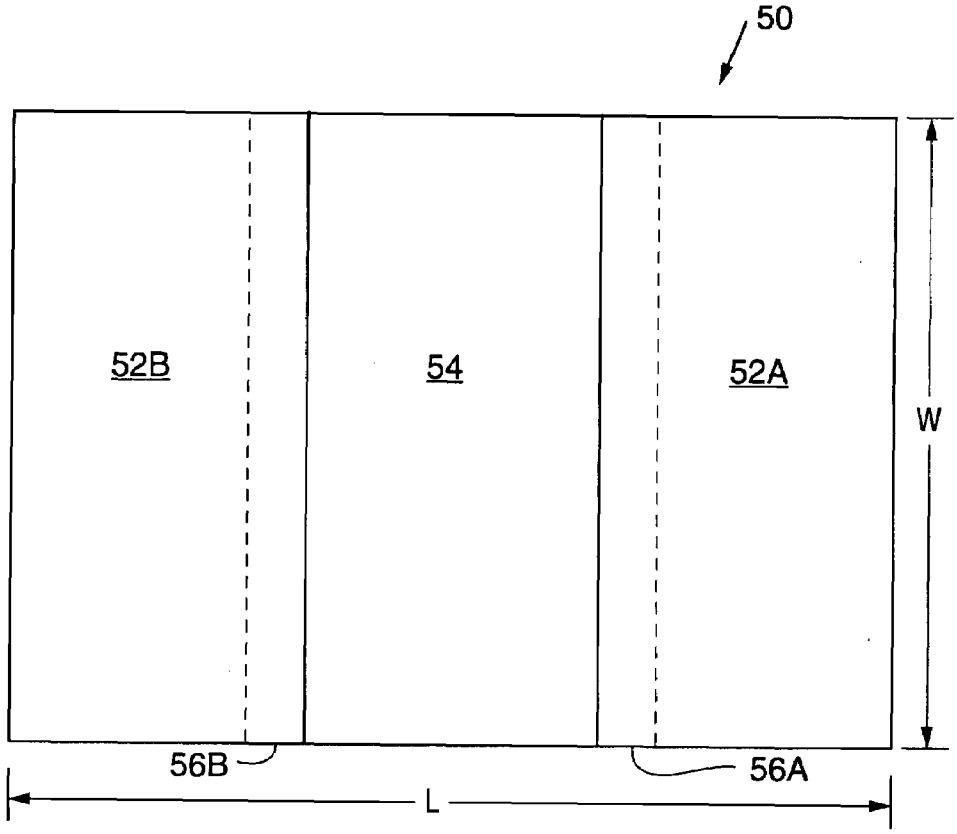
FIGS. 5 and 6 are respective plan and elevational views of one embodiment of a spine support structure.
Figure 6:
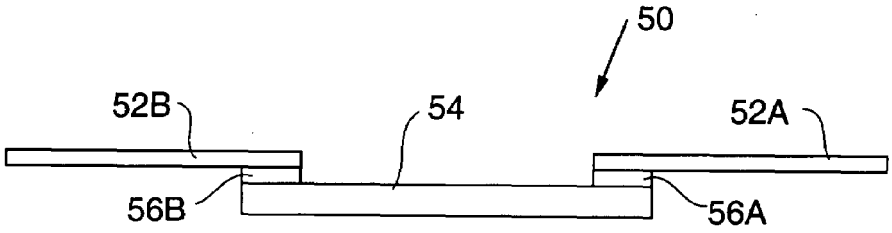

The fourth major step, as indicated be element 64, utilizes a spine support structure depicted in FIGS. 5 and 6. FIG. 6 is in schematic form, with thickness of the various elements being exaggerated for purposes of clarification. The spine support structure 50 includes a pair of release sheets 52A and 52B and a central spine member 54. As can best be seen in FIG. 5, the outer edges of the central spine member 54 overlap the respective inner edges of the release sheets 52A and 52B. A first pressure sensitive adhesive layer 56A is disposed intermediate the overlapping portions of spine member 54 and release sheet 52A. Similarly, a second pressure sensitive adhesive layer 56B is disposed between the overlapping portions of spine member 54 and release sheet 52A.

The overall dimensions of the spine support structure 50 in terms of width and length are selected to match those of prior art cover 36. Assuming, for example, that a stack of 8½ by 11 inch sheets is to be bound, the width W of structure 50 will be 11 inches, with the length L needing be only of sufficient value so as to simulate a cover 36 when placed in a perfect binding machine.

Spine member 54 is typically made of cloth, such as linen. The release sheets are made from release paper sold by Technicote under the designation 80# SCK L3 Silicone liner. A pressure sensitive adhesive manufactured by National Starch and Chemical Company and marketed under the designation Instant-Lok, type HL PSA 20-81, has been found suitable for this application. The release sheets 52A and 52B initially function to cover the pressure sensitive adhesive layers 56A and to provide a structure so as to simulate the form factor or shape of a conventional cover 36 when inserted in a perfect binder machine. The release sheets 52A, 52B composition is such that the sheets can be manually separated from the spine member 54 without damaging either the spine member or the adhesive layers 56A and 56B.

As indicated by element 64, the spine support structure 50 is then applied to the assembly using the perfect binder machine. Since the form factor of the spine support structure 50 is similar to that of a prior art cover 36, the structure can be manipulated by the machine in the same manner as a cover. The resultant assembly is depicted schematically in FIG. 7. The spine support structure 50 is wrapped around the edge of the stack, with the spine member 54 being secured to the stack edge by way of the hot melt adhesive 70.

Figure 7:
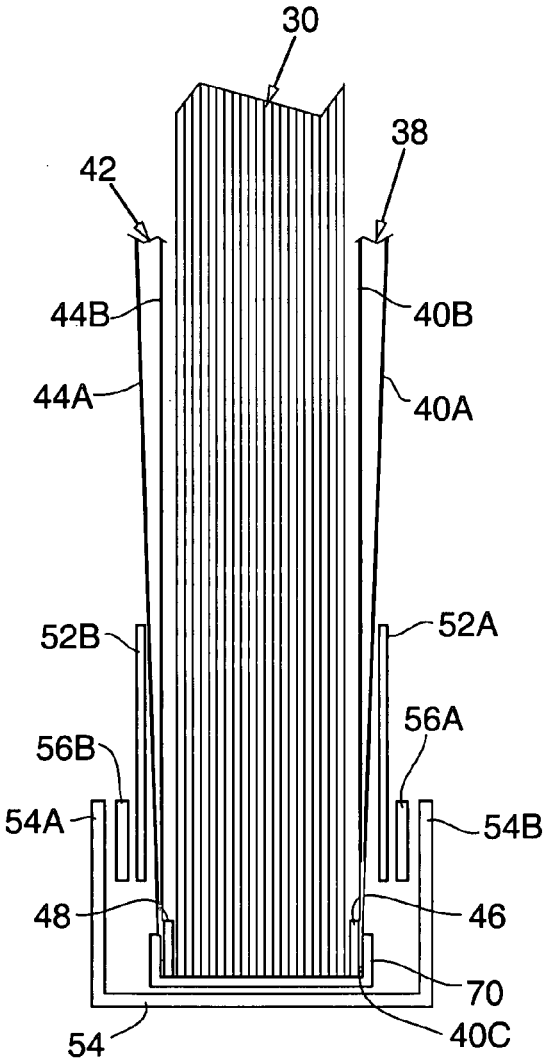
FIG. 7 is an elevational view of a schematic representation of the spine support structure of FIGS. 5 and 6 applied to a stack of sheets.

It can be seen from FIG. 7 that only the lower portion of spine member 54 is attached to stack 30. In order to secure the upper sections 54A and 54B of the substrate to the stack, the user slightly folds the respective release sheets 52A and 52B away from the stack and then removes each of the sheets from the structure and represented by element 66 of the flow chart. This exposes the two pressure sensitive layers 56A and 56B. The user then presses the two upper spine member sections 54A and 54B back against the stack thereby causing the sections to be secured to the stack by way of the pressure sensitive adhesive layers 56A and 56B as illustrated schematically in FIG. 8.

The next step of the process is to apply a hardcover assembly to bound book 72, as indicated by element 68 of the flow chart. FIG. 9 shows details of a hardcover assembly 74 that is applied to the bound stack 72 of FIG. 8. Preferably, the cover assembly 74 is completely assembled and sold separately to the user. As will be described, the cover assembly 74 will be manufactured in various sizes to accommodate differing size stacks 72 in terms of stack thickness. It is further anticipated that a user can request that certain information be preprinted on the assembly 74, including title information and any other graphics. As will be described, hardcover assembly 74 includes the front and back cover sections halves 74A and 74B, respectively, separated by a spine section 74C.

The cover assembly includes a pair of relatively stiff cover boards 76A and 76B made of cardboard or the like. The cover boards 76A and 76B are typically 8⅜ inches by 11 5/16 inches for binding 8½ by 11 inch stack 72. The cover boards are covered with a flexible cover membrane 78, typically fabric, which is folded around the edges of the cover boards, as depicted in FIG. 9. That part of the cover membrane 78 disposed intermediate the opposite edges 80A and 80B of the cover boards is unsupported and is thus relatively flexible. A length of fabric or stiff paper, typically 0.010 inches thick, is preferably disposed in the spine section 74C of the hardcover assembly 74 so as to slightly stiffen the membrane 78 in that location so that a desired shape is achieved when the bound book is opened and closed. The membrane regions 82A and 82B disposed between the respective edges of the spine section 84 and the respective edges 80A and 80B of the cover boards 76A and 76B are referred to as gutter regions. The gutter regions 82A and 82B are each fixed in width of ⅜ of an inch. The gutter regions define the flexible portion of the cover membrane. Alternatively, a spine board (not depicted), made of the same material as the cover boards 76A and 76B and having a shape that generally corresponds to the spine region 84, can be used. The spine board, which is typically 0.088 inches thick, functions to stiffen the spine 84, with spine flexibility being provided by the flexible gutter regions 82A and 82B disposed between the respective edges of the cover boards 76A and 76B and the respective edges of the spine board. When the spine board is used, the gutter region 82A and 82B widths are preferably increased slightly to 7/16 of an inch.

The spine region 84 varies in width depending upon the width of the bound stack 72 to be bound. The cover assemblies are preferably prefabricated in various widths to accommodate stacks 72 of various widths as set forth below in Table 1.

TABLE 1

| Model | Spine 84 Width (inches) | Stack 72 Thickness (inches) |
|---|---|---|
| A | ⅜ | To ¼ |
| B | ½ | ¼ to ½ |
| C | ¾ | ½ to ¾ |
| D | 1 | ¾ to 1 |
| E | 1¼ | 1 to 1¼ |
| F | 1½ | 1¼ to 1½ |

The number of available spine widths can be increased or decreased from the values set forth above in Table 1, with a larger number increasing the difficulty of maintaining an adequate inventory and a smaller number detracting somewhat from the appearance of the final product in the spine region.

Figure 9:
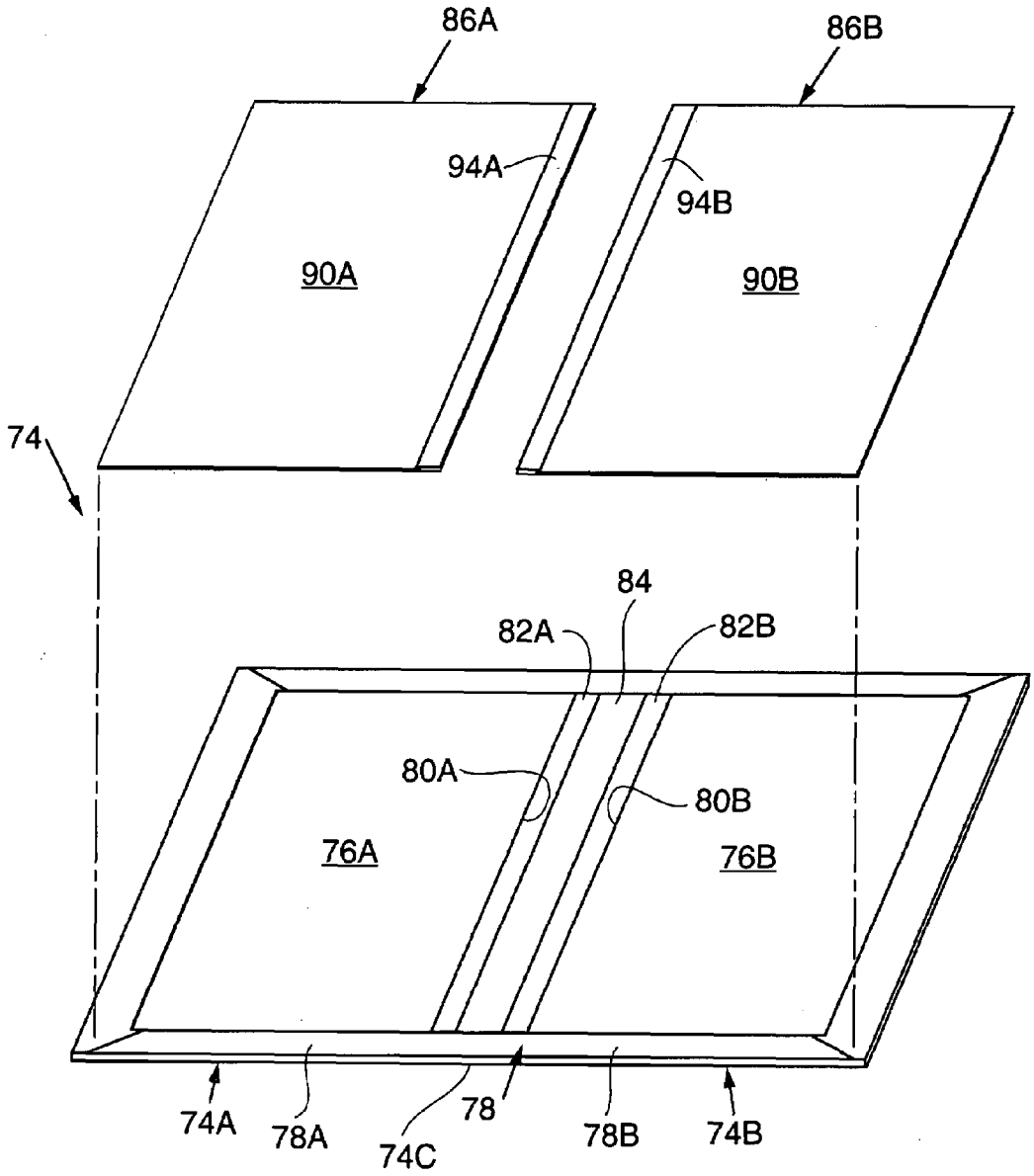
FIG. 9 is a perspective exploded view of the hardcover assembly, with the pressure sensitive front and rear sheets structures shown displaced from the remainder of the assembly.
Figure 10:
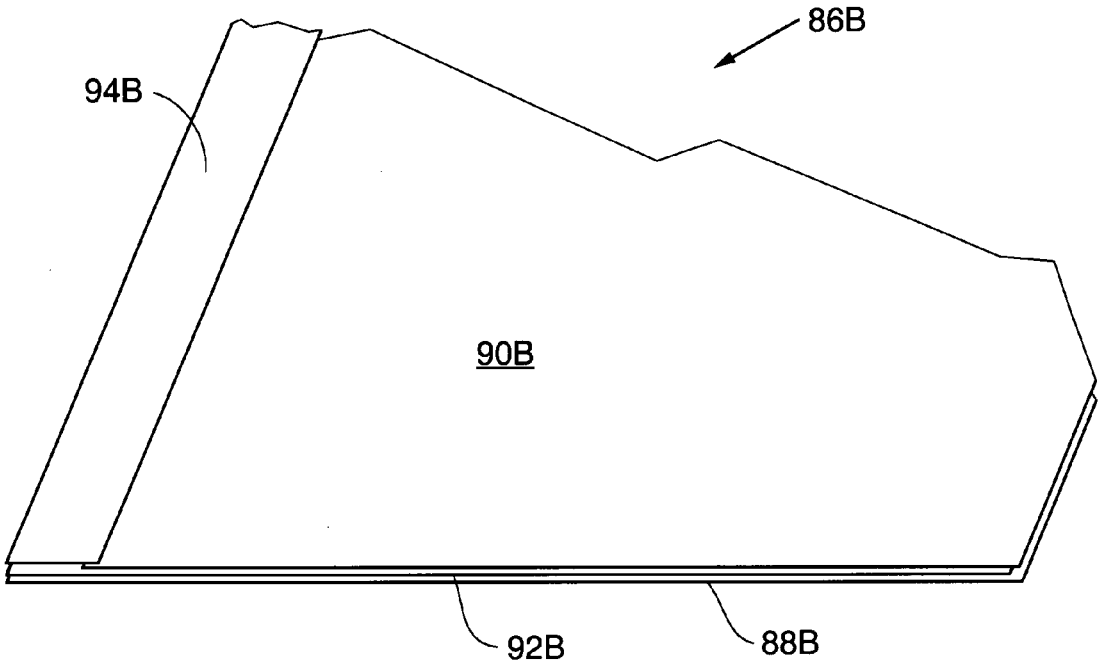
FIG. 10 is a perspective view of one of the two pressure sensitive adhesive sheet structures.
Figure 11:
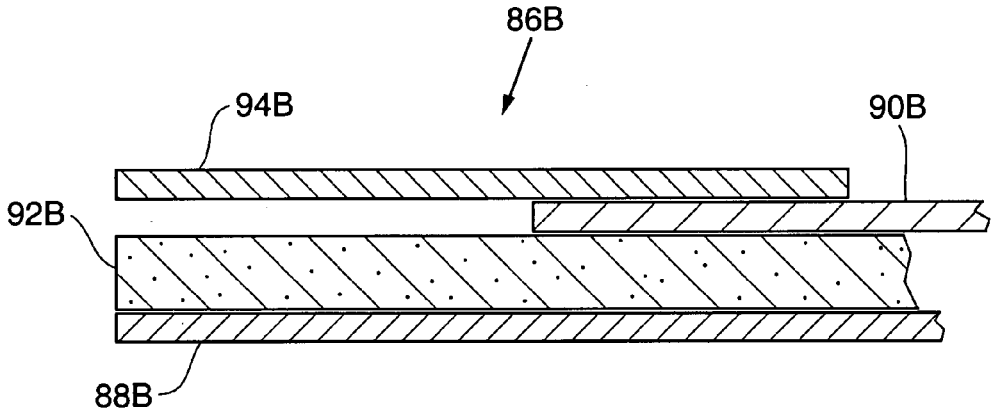
FIG. 11 is a cross-section elevational view of a portion of the adhesive sheet structure of FIG. 10.

Referring back to FIG. 9, the cover assembly 74 is prefabricated using a pair of pressure sensitive adhesive sheets structure 86A and 86B. Further details of the adhesive sheets are also shown in FIGS. 10 and 11. Adhesive sheet structures 86A and 86B are dimensioned 8¼ by 10¾ inches when the bound stack 72 size is 8½ by 11 inches, to cover the interior periphery of the folded portions of the cover membrane 78A and 78B and to further secure the periphery of the bottom sheets 88A and 88B of the sheet structure ensures that sheets 44A and 40A of the end leafs (FIG. 8) completely cover sheets 88A and 88B despite any small misalignment. Each sheet structure includes a respective bottom sheet 88A and 88B and an upper major release liner 90A and 90B. A layer of pressure sensitive adhesive 92A and 92B is disposed intermediate the upper liner and bottom sheet. A pressure sensitive adhesive manufactured by National Starch and Chemical Company and marketed under the designation Instant-Lok, type HL PSA 20-81, has been found suitable for this application. The adhesive layers 92A and 92B are preferably 0.003 to 0.004 inches in thickness.

The upper major release liners 90A and 90B are disposed over a majority of the underlying pressure sensitive adhesive layers. Generally, at least 75% of the adhesive layers are covered by the respective upper major release liners 90A and 90B, with a remaining strip of the adhesive along the inner edge of the sheet structures not being covered by the major release liners 90A and 90B. Instead, upper minor release liners 94A and 94B are disposed over the exposed adhesive strips. This relationship is shown schematically in FIG. 11 (not to scale) where a portion of the sheet structure 86B is depicted. As can be seen, the pressure sensitive adhesive layer 92B is disposed between the bottom sheet 88B and upper major and minor release liners 90B and 94B. That portion of the adhesive layer 92B not covered by the upper major release liner 90B is covered by a separate upper minor release liner 94B. The minor release liner 94B is actually positioned contacting the adhesive layer 92B and is secured in place by the adhesive layer. All of the release liners 90A, 94A, 90B and 94B are fabricated from the same material used for sheets 52A and 52B. As part of the prefabrication of the hardcover assembly, conventional case glue 96 (not depicted in FIGS. 10 and 11) is applied to the top of the cover sections 74A and 74B and to the bottom sheets 88A and 88B. The sheet structures are then positioned over the respective cover sections 74A and 74B as shown in FIG. 9 so that the sheet structures will be secured to the cover sections by the case glue. Thus, the sheet structures 86A and 86B are secured to the cover boards 76A and 76B and to the peripheral portions of the cover membrane 78 by way of the case glue. This completes the prefabrication of the hardcover assembly 74.

Figure 12:
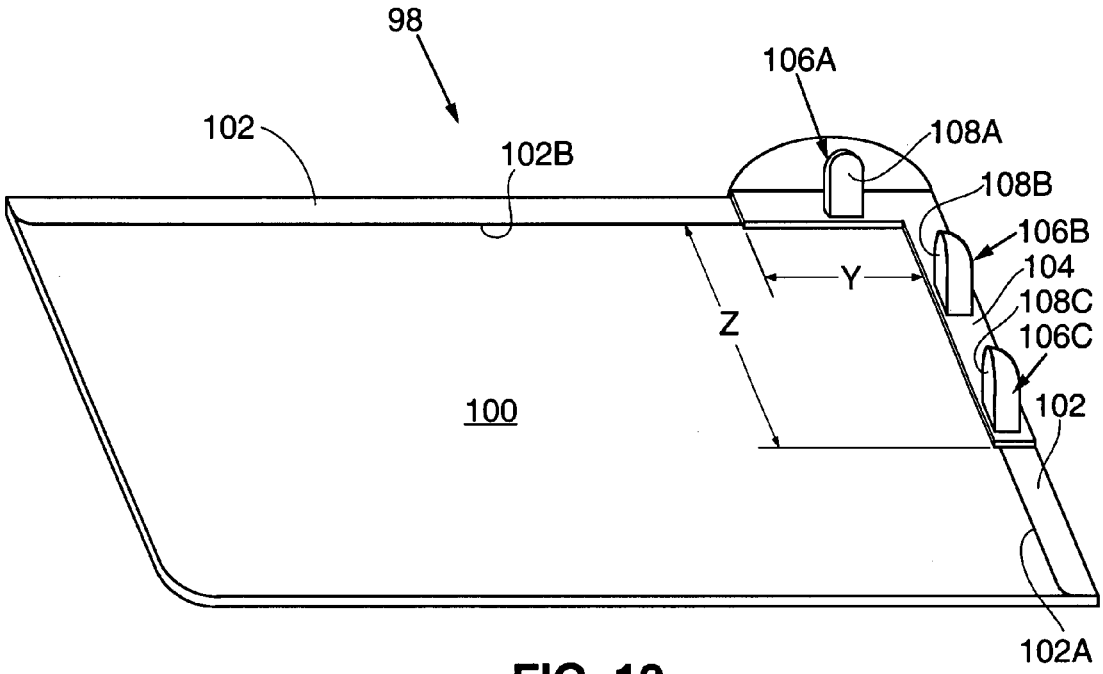
FIG. 12 is a perspective view of the guide apparatus used to attach the hardcover assembly to the bound stack.
Figure 13:
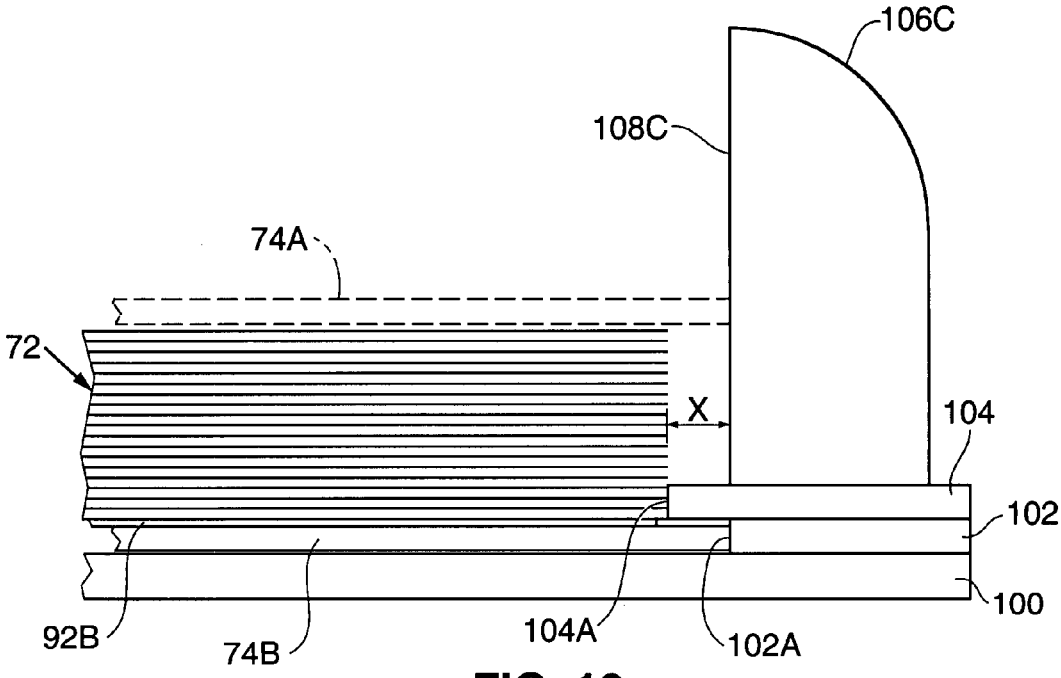
FIG. 13 is an expanded side view of a portion of the guide apparatus of FIG. 12 with a stack to be bound shown in position.

Referring now to FIGS. 12 and 13, a guide apparatus 98 is disclosed for use in carrying out the binding process. The guide apparatus includes a flat base member having a receiving surface 100 that is somewhat larger that the largest book to be bound when the book is in the open position. A stop member 102 having two orthogonal segments is supported on the upper surface 100 of the base member and extends around two adjacent sides of the base member. A ledge member 104, also having two orthogonal segments, is supported above the stop member 102 and, as can be in FIG.

13, have outer edges 104A which extend past the edge 102A of the stop member a small distance X, with the overhang being typically 0.16 inches. The height of the ledge member above the support surface is great enough to accommodate the thickness of the cover sections 74A and 74B of the cover assembly 74. The ledge member 104 extends along stop member 102 in one direction a distance Y (FIG. 12) which is somewhat smaller than the closed width of the smallest book to be bound. The distance Z, the distance that the ledge member 104 extends along stop member 102 in the other direction, is typically about twice dimension Y.

The guide apparatus 98 also preferably includes two or more vertical stop members, such as 106A, 106B and 106C, with vertical stop member 106A being supported on ledge member 104 about one third of the distance Y of the ledge member from the corner formed by the intersection of the two ledge member 104 segments. Vertical stop members 106B and 106C are at approximate equal distances along the other ledge member 104 segment. As can best be seen in FIG. 13, the vertical stop members each have a planar surface, surface 108C for example, that coincides with the inner edge, edge 102A for example, of the stop member. This configuration also applies to the planar surfaces 108A and 108B of vertical stop members 106A and 106B. Planar surface 108A coincides with edge 102B of stop member 102, with edges 102A and 102B being orthogonal with respect to one another. Edges 102A and 102B are sometimes referred to herein as the lower cover stops. Vertical stop members 106A, 106B and 106C are sometimes referred to herein as the upper cover stops.

Figure 14A:
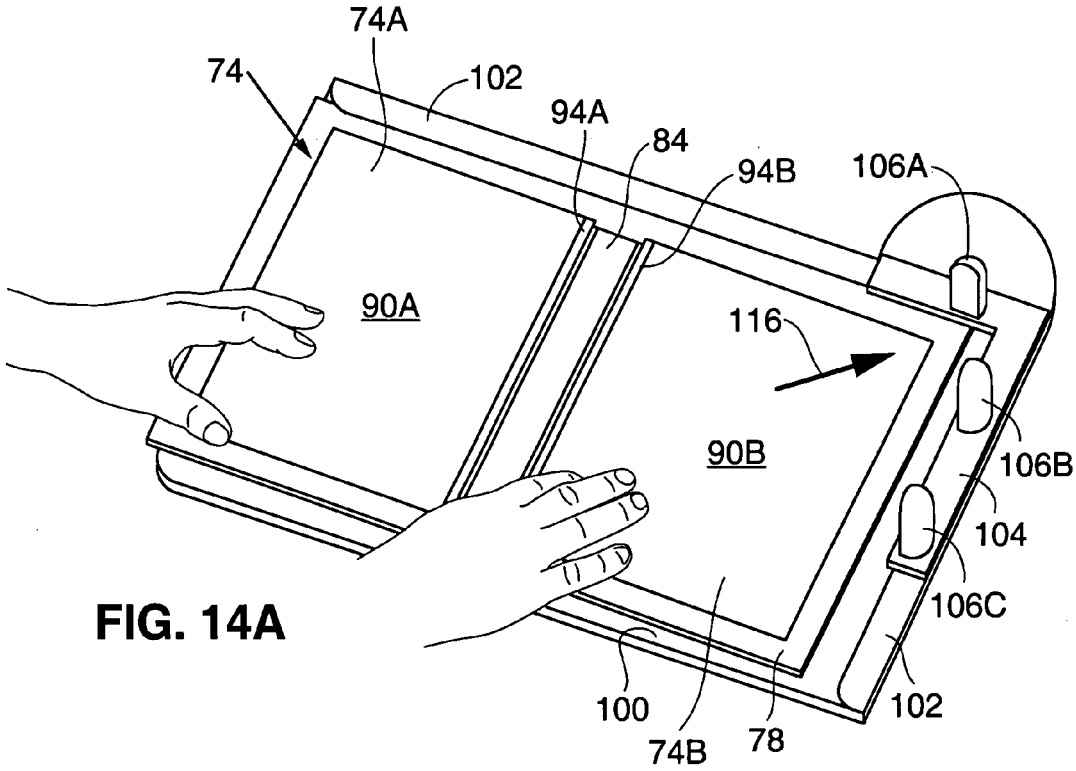
FIGS. 14A-14M depict the process for applying the hardcover to the bound book.

The sequence for applying the hardcover to bound stack 72 will now be described, starting with reference to FIG. 14A. The opened hardcover assembly 74 is first positioned on the guide apparatus receiving surface 100, with the upper release liners 90A and 90B facing upwards. As indicated by arrow 116, the hardcover assembly is moved along the surface 100 of the guide apparatus until the edges of cover section 74B is positioned under the ledge member 104, abutting the inner edges 102A and 102B of the stop member 102, as shown in FIG. 13 with respect to edge 102A. Thus, the outer edge 104A of the ledge member 104 will be positioned a fixed distance X from the edge of cover 74B along the full length of both orthogonal segments of the ledge member 104. The outer edge 104A will provide a guide for positioning the bound stack 72, as will be described. Thus, edge 104A will sometimes be referred to herein as a book stop.

Figure 14B:
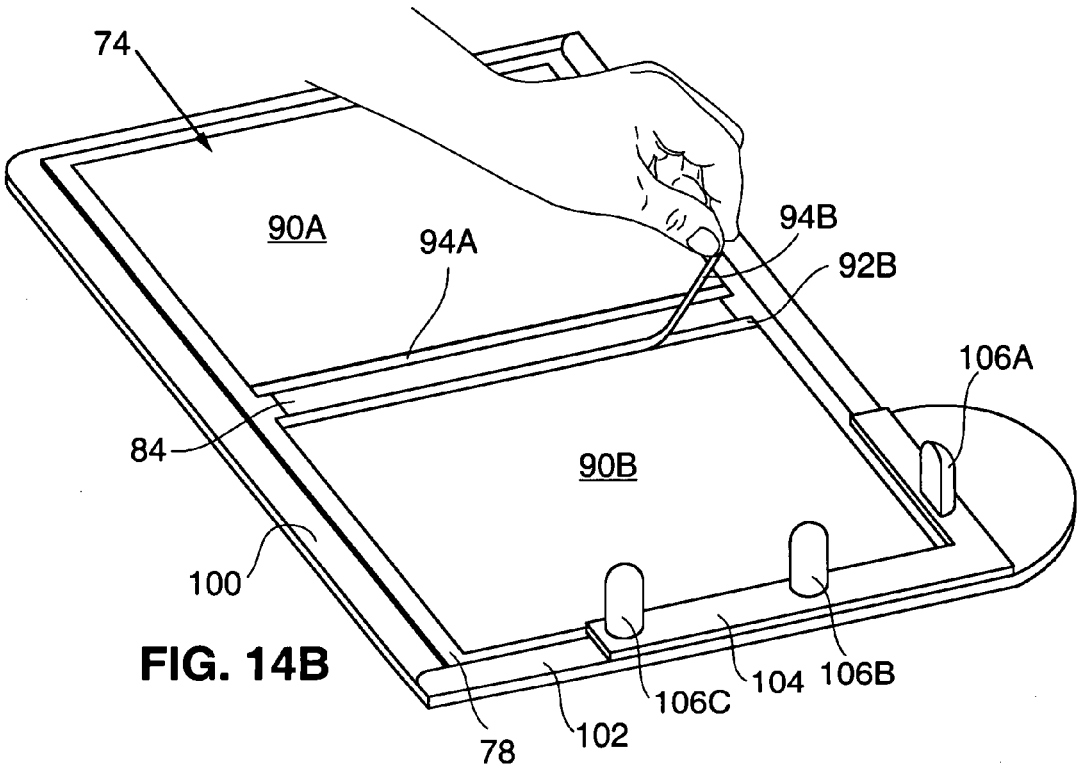
Figure 14C:
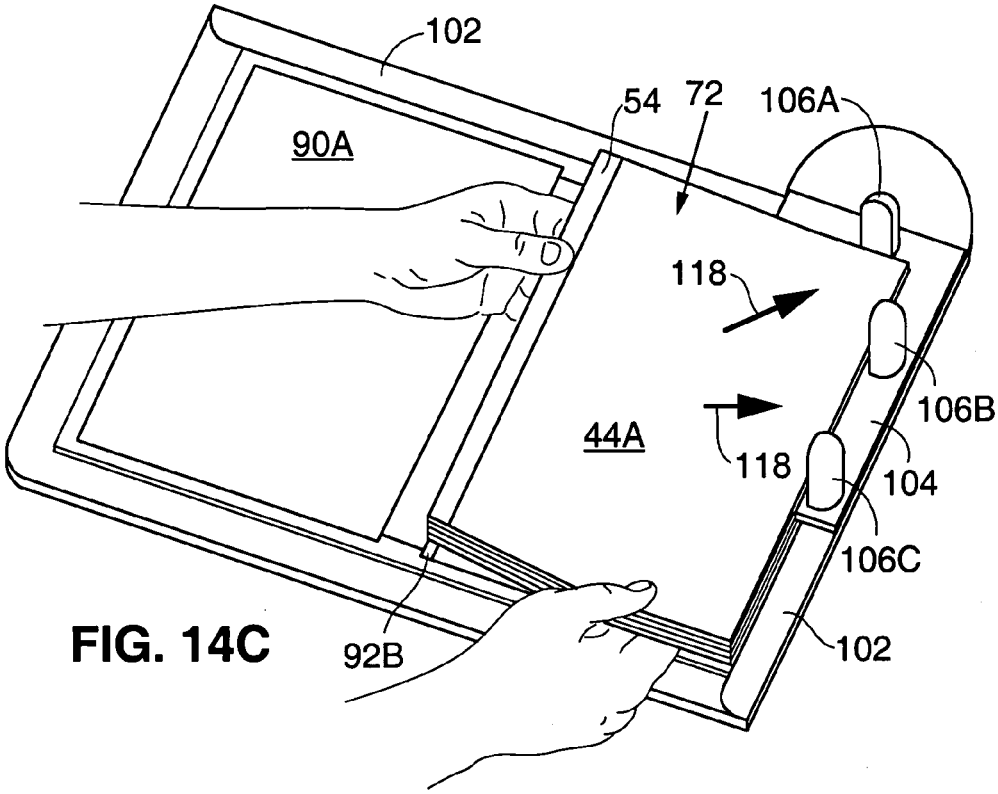
Figure 14D:
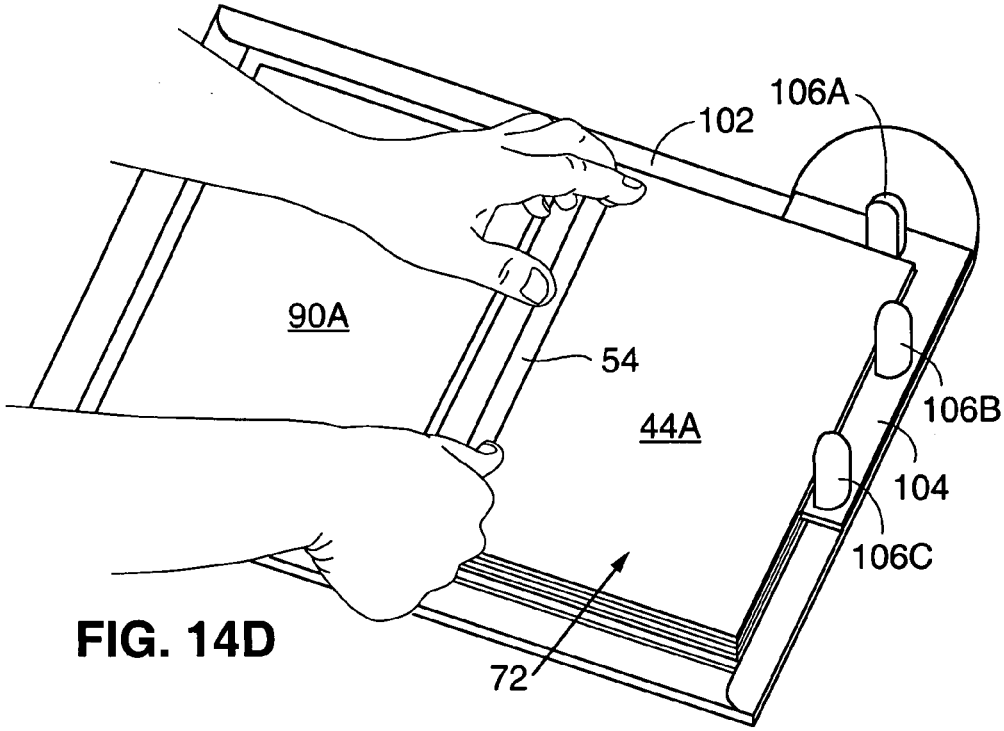

Once the hardcover assembly 74 is properly positioned on the guide apparatus 98, the user manually separates the upper minor release liner 94B as shown in FIG. 14B from the assembly 74. This will expose a relatively narrow strip of the underlying pressure sensitive adhesive 92B adjacent spine region 84. Next, the bound stack 72 is placed over the upper major release liner 90B, with the edges of the stack engaging edge 104A of the ledge member 104 along both orthogonal segments as shown in FIG. 14C. FIG. 13 shows the edge of stack 72 engaging edge 104A along one of the two segments. As shown in FIG. 14C by arrows 118, that portion of stack 72 along the exposed adhesive 92B is not placed on the exposed adhesive until the orthogonal edges of the stack are positioned against edge 104A of both segments. Once the correct position is achieved, the stack is forced down upon the exposed pressure sensitive adhesive 92B as shown in FIG. 14D. This operates to secure sheet 40A of stack 72 to cover section 74B of the hardcover assembly 74 in a correctly aligned position.

Figure 14E:
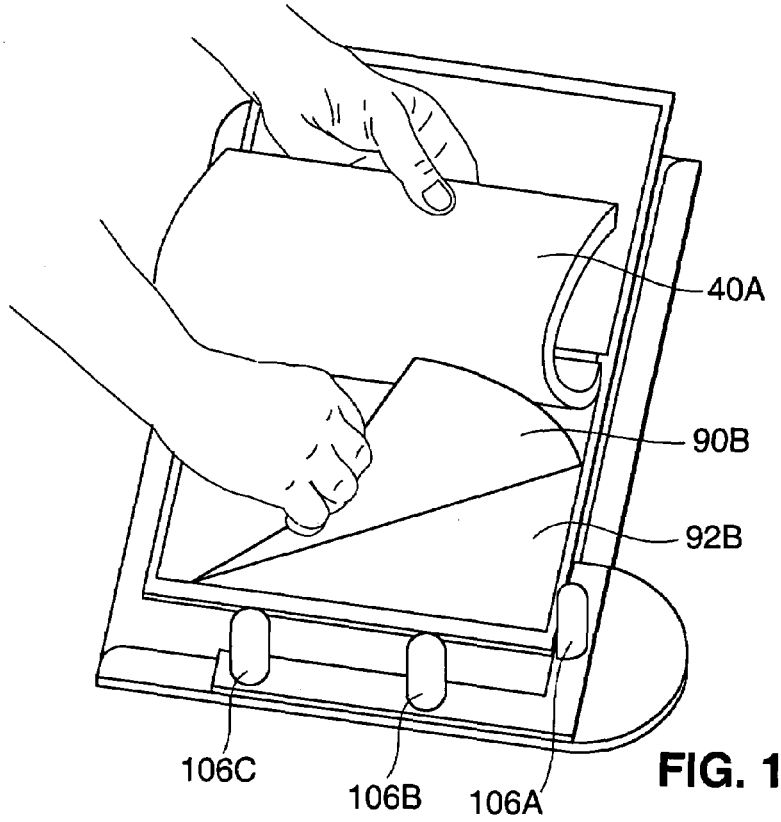
Figure 14F:
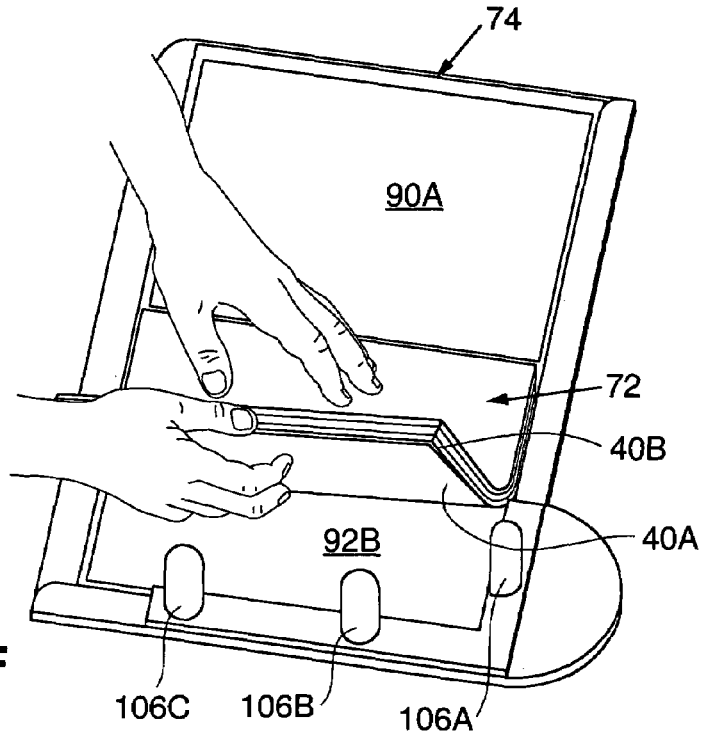
Figure 14G:
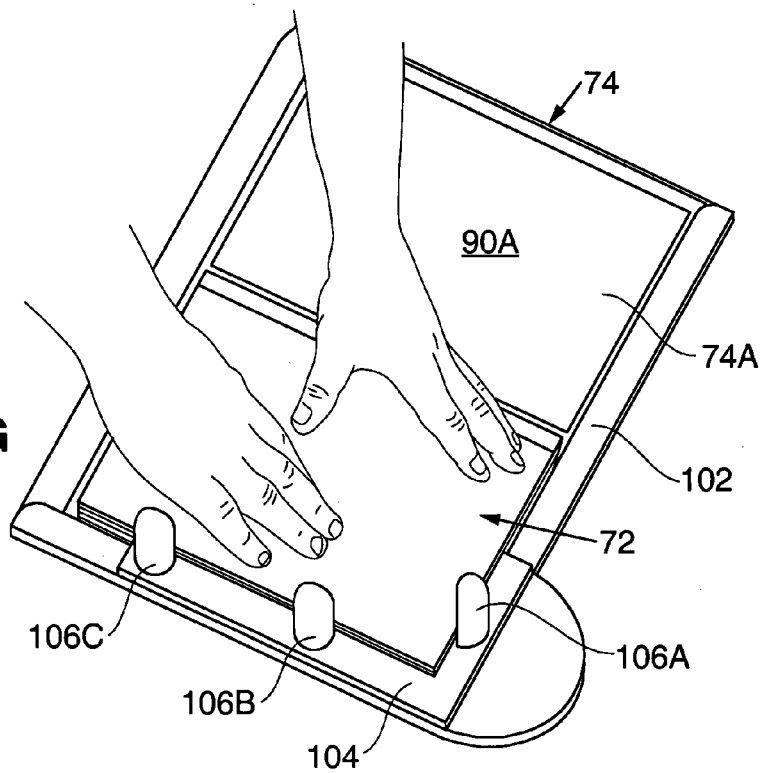

The next step is to secure the remainder of the sheet 40A of stack 72 to the adhesive 92B of assembly 74. Referring to FIG. 14E, the free edge of stack 72, including sheet 40A, is lifted up and rotated away from the upper major release liner 90B. This permits the release liner 90B to be separated from the hardcover assembly 74 thereby exposing the remainder of the pressure sensitive adhesive 92B. As shown in FIG. 14F, the spine portion of stack 72 held down against the hardcover assembly 74 with one hand while stack 72 is rotated over the adhesive 92B with the other hand. As shown in FIG. 14G, the user then presses the stack 72 down on the hardcover assembly 74. This causes the remainder of sheet 40A of the stack to be secured by the remainder of adhesive 92B to cover section 74B of the hardcover assembly 74. The second cover section 74A of the hardcover assembly will now be attached.

Figure 14H:
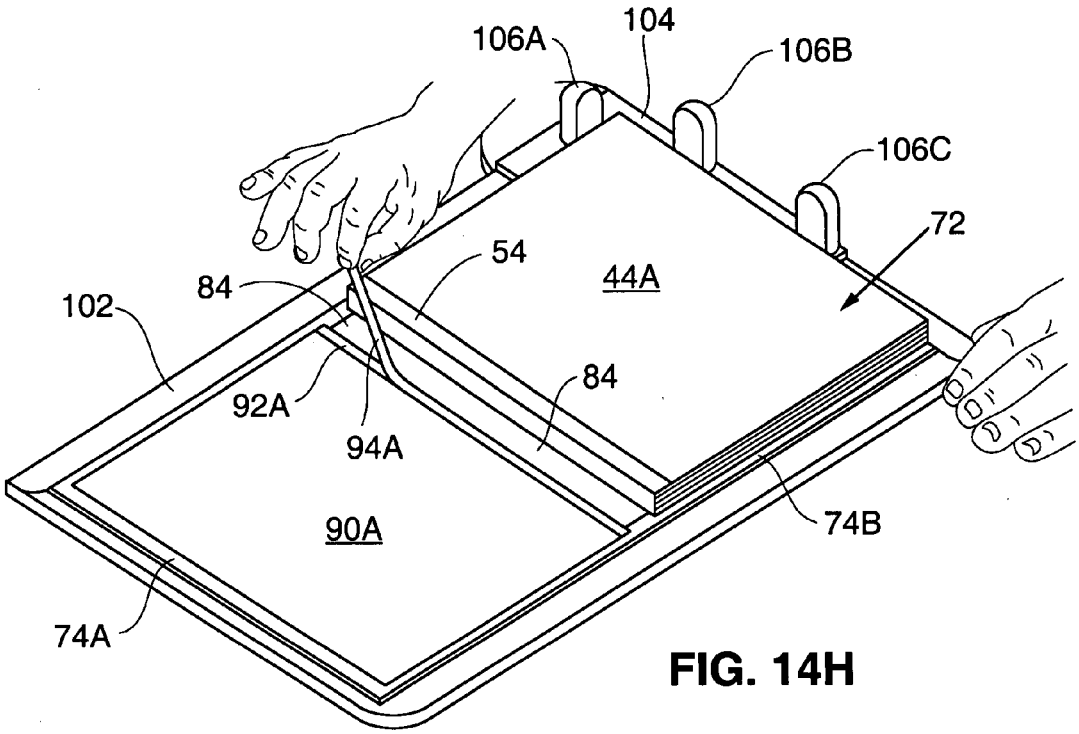
Figure 14I:
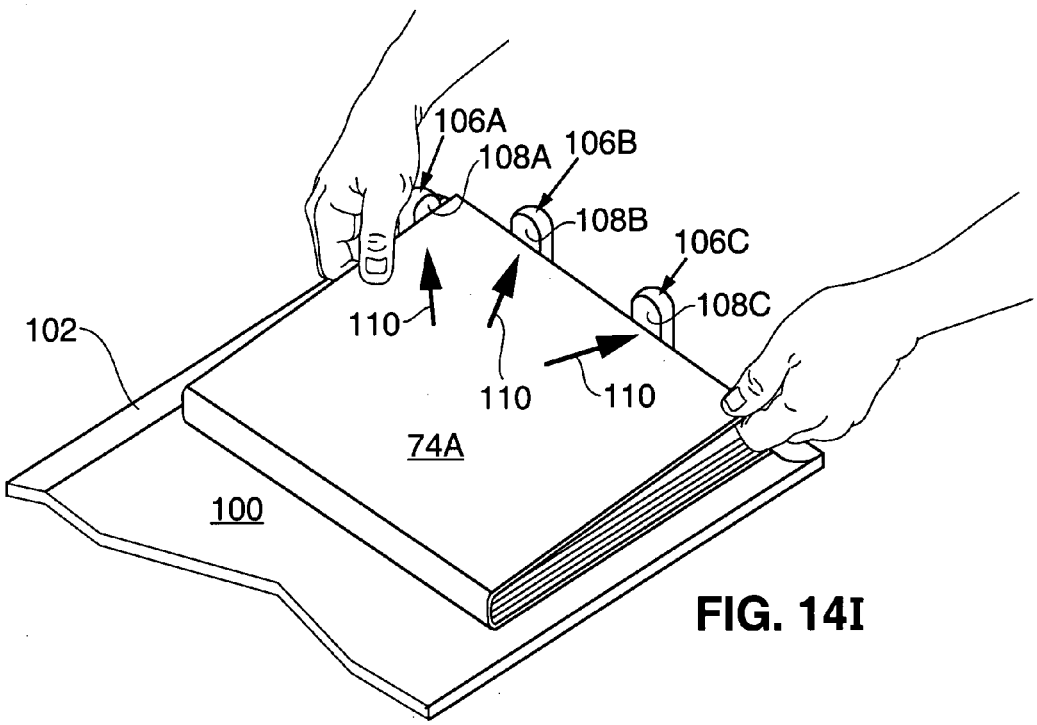
Figure 14J:
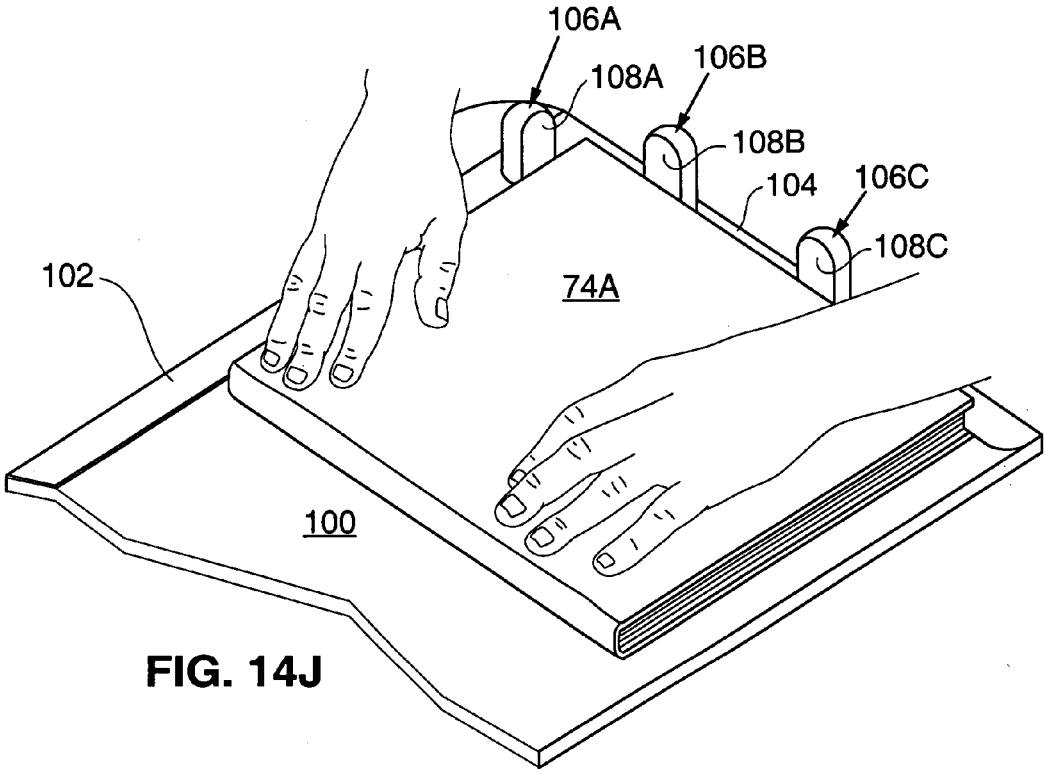

Referring to FIG. 14H, the upper minor release liner 94A is next separated from the hardcover assembly 74 thereby exposing a strip of pressure sensitive adhesive 92A adjacent spine region 84. The user then lifts the cover section 74A of the hardcover assembly away from the surface 100 of the guide apparatus and rotates the cover 74A around the spine. As indicated by arrows 110 of FIG. 14I, the cover section 74A is positioned so that the edges of the cover section 74A contact the planar surfaces 108A, 108B and 108C of the respective three vertical stop members 106A, 106B and 106C. This is shown in phantom in FIG. 13. The hardcover assembly 74 is then positioned correctly with respect to the bound stack 72. The user then forces the cover section 74A down as shown in FIG. 143 so that an edge of sheet 44A of stack 72 is secured to the hardcover assembly 74 by way of the exposed strip of adhesive 92A.

Figure 14K:
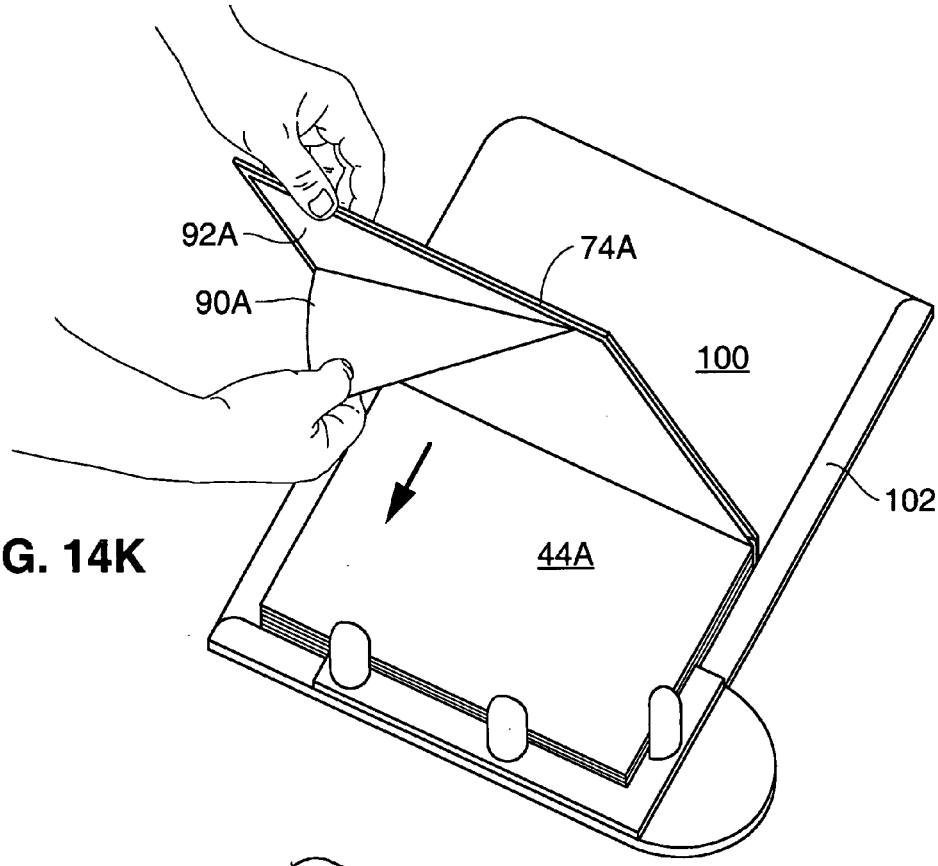
Figure 14L:
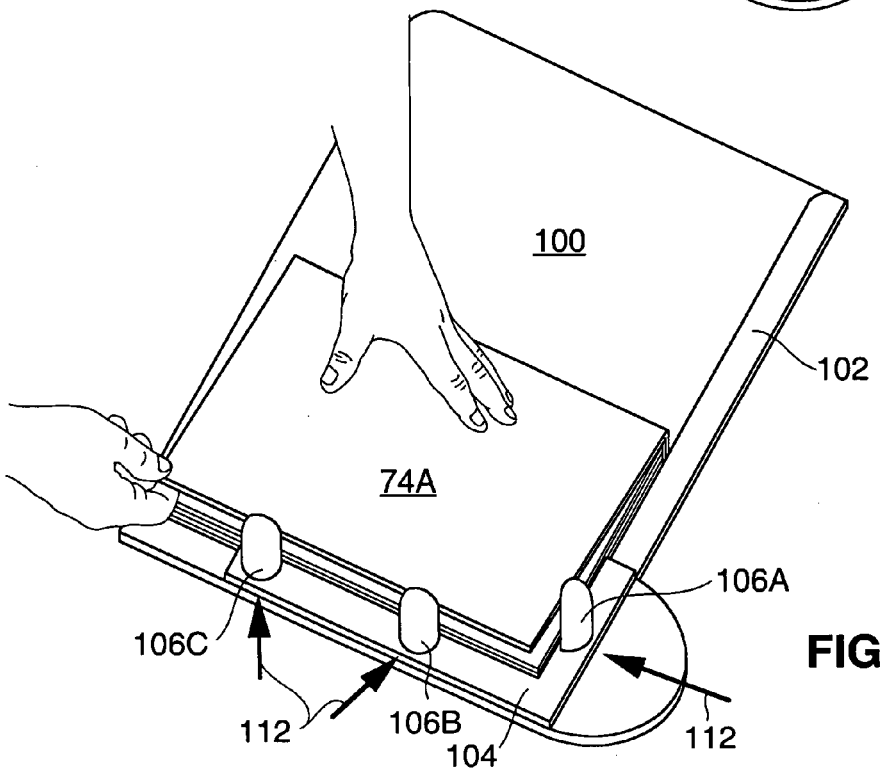
Figure 14M:
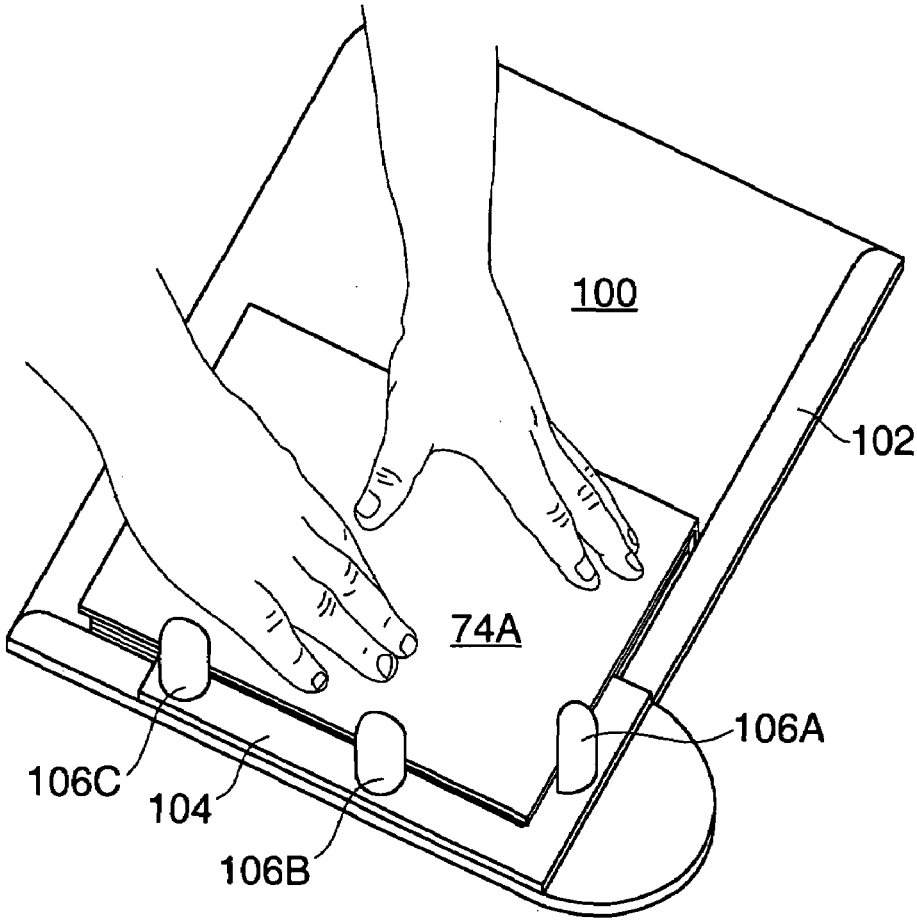

As shown in FIG. 14K, the user then lifts cover section 74A up and rotates the cover away from stack 72, with a narrow strip of sheet 44A of the stack remaining secured to cover section 74A. This permits upper major release liner 90A to be separated from hardcover assembly 74 thereby exposing the remainder of pressure sensitive adhesive layer 92A. Cover section 74A is then placed rotated back down onto stack 72, where the edges of the cover should again be in contact with the surfaces 108A, 108B and 108C of the respective stops 106A, 106B and 106C as shown in FIG. 14L by arrows 112. The user then presses down on cover section 74A as shown in FIG. 14M thereby securing the cover section 74A to folded liner sheet 40A of stack 72. This completes the binding sequence.

Figure 15A:
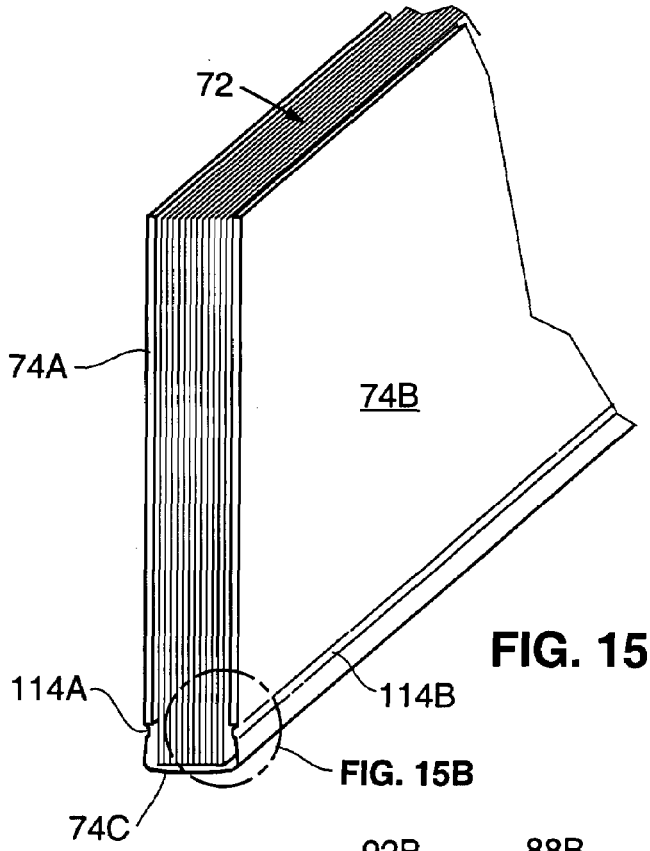
FIGS. 15A and 15B are perspective views of portions of the completed hardcover book.
Figure 15B:
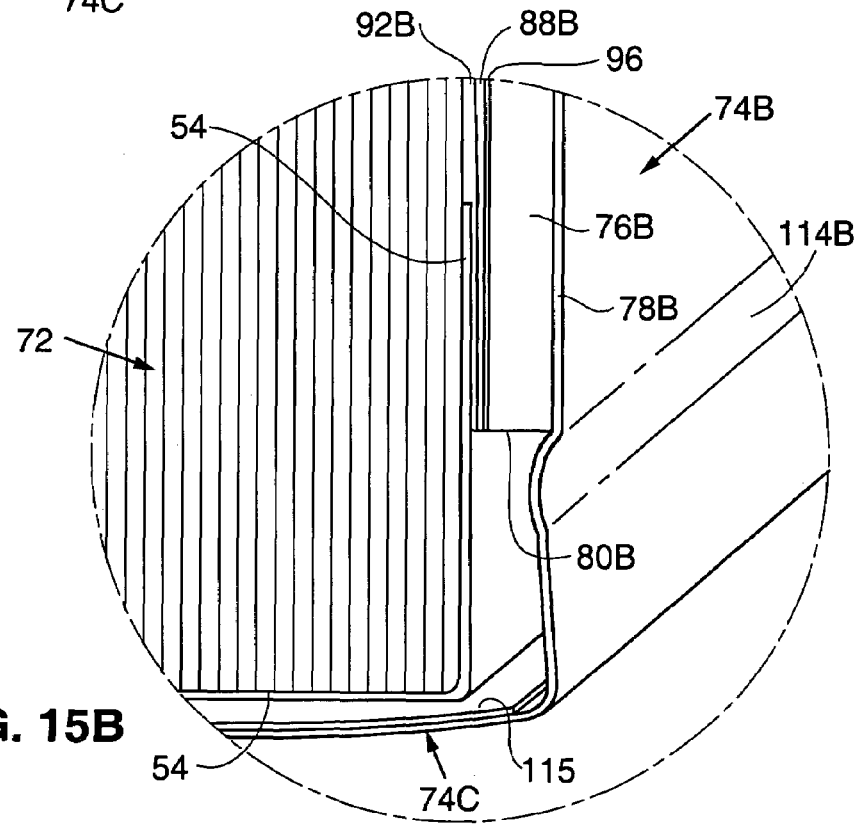
Figure 16:
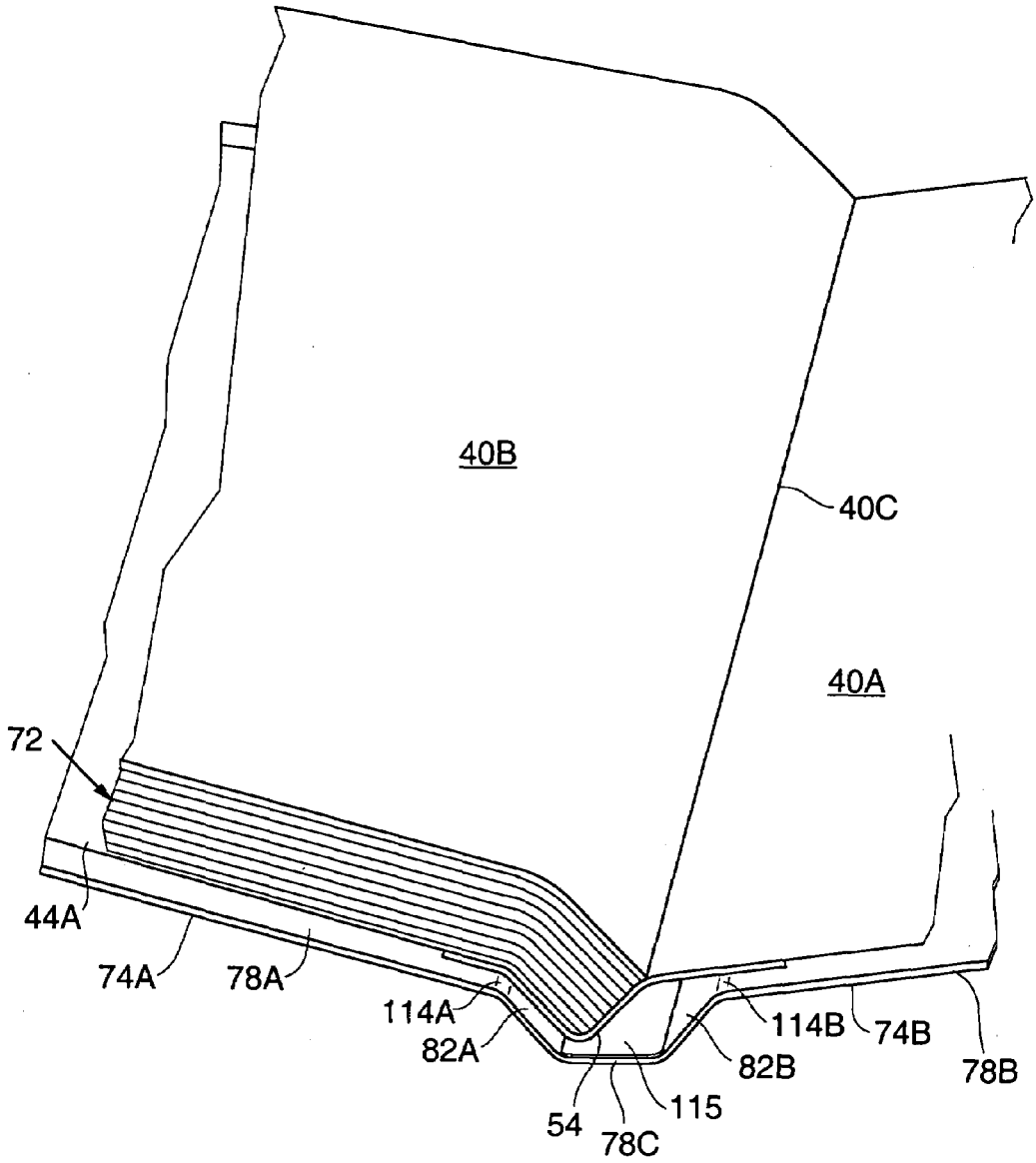
FIG. 16 is a perspective broken view of the completed book shown in an open position.

FIGS. 15A and 15B show the completed book in a closed position and FIG. 16 shows the book in an opened position, at the last page of the book, so that sheets 40A and 40B of end leaf 38 are depicted. Sheet 40A is secured to hardcover section 74B by way of adhesive 92B and is secured to stack 72 by way of spine member 54. Sheet 44A at the front of the book (not depicted) is secured to hardcover section 74A by adhesive 92A and to stack 72 by way of spine member 54. The region between spine member 54 and the spine region 74C is not attached so that, when the book is opened as shown in FIG. 16, the spine region does not attempt to fold with the spine member 54. Thus, the book will lay flat when opened and will not tend to fold shut. Further, the spine region 74C will not distort when the book is opened to the same degree it would if the spine region 74C was attached. As previously noted, a fairly stiff paper strip 115 is positioned in the spine region intermediate the gutter regions 82A and 82B (FIG. 9) so as to hold the shape of the spine region 84 when the book is opened and closed. Fold lines 114A and 114B are formed naturally in the membrane 78 in the regions near the edges 80A and 80B of the cover boards thereby further enhancing the appearance of the final product.

Figure 8:
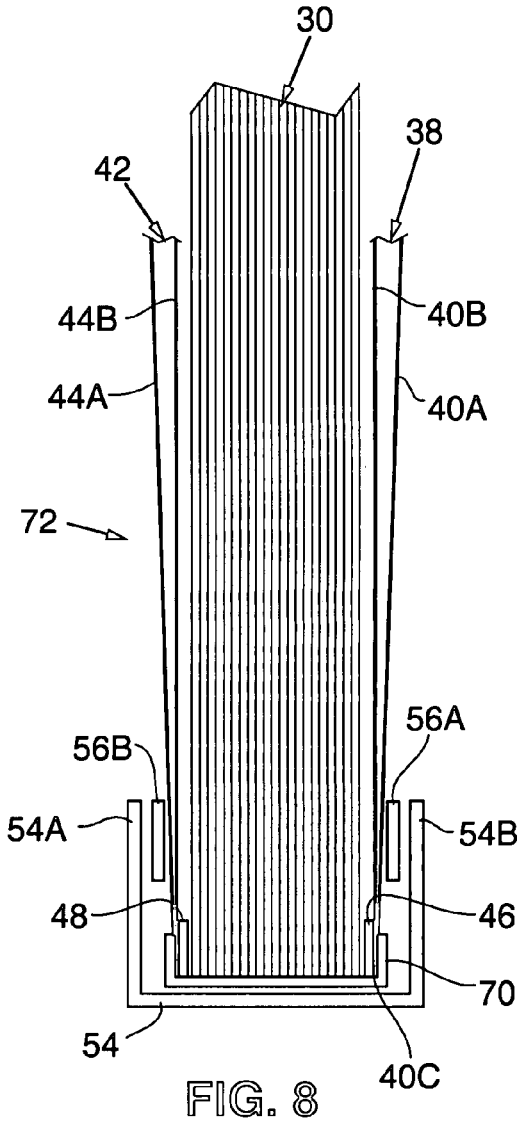
FIG. 8 is an elevational view of a schematic representation of the structure of FIG. 7 after the release sheets have been removed.

It should be noted that spine member 54 is securely attached to the stack or book block 30 by way of hot melt adhesive 70 as can be seen, for example, in FIG. 8. Further, the end leafs 38 and 42 are securely attached to the book block 30 by way of the spine member 54, with the hardcover assembly being secured in place by the end leafs. Thus, the resultant bound book avoids any interface between the hot melt adhesive and a cold adhesive previously described in the Description of Related Art, an interface which tends to fail over time.

Figure 17A:
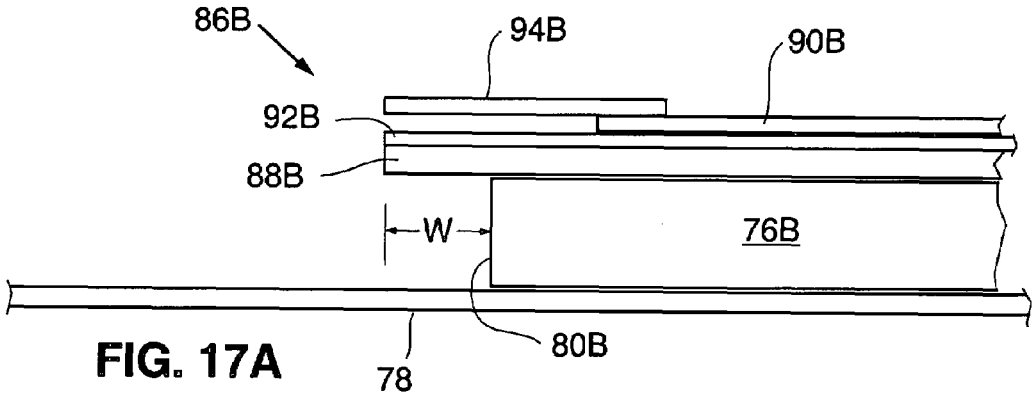
FIGS. 17A-17C depict a further variations of the hardcover assembly.
Figure 17B:
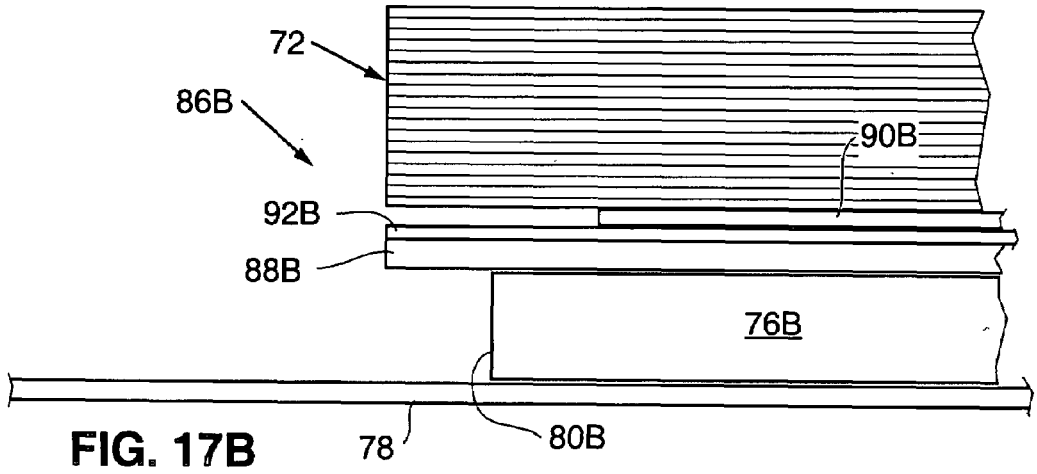
Figure 17C:
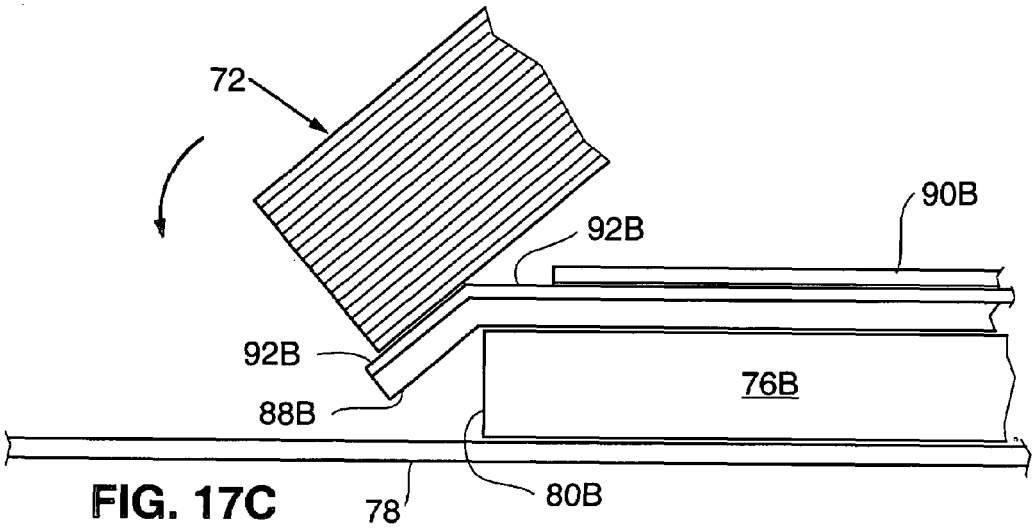

Referring back to FIG. 14E, when the user lifts up the free edge of stack 72 so as to permit the upper release liner 90B to be removed, sometimes there may be a tendency for users to rotate the entire stack about the edge of the stack so as to expose the upper major release liner 90B for removal. This rotation, which is actually not necessary to expose the release liner, tends to cause the stack to be lifted up from the narrow strip of adhesive 92B so that the stack becomes separated from the adhesive thereby destroying the desired placement of the stack on the hard cover section 74B. This problem can be largely eliminated by placing the pressure sensitive adhesive sheet structure 86B (FIG. 9) so that the edge of the structure extends past the edge 80B of cover board 76B by a small amount W as shown in FIG. 17A. FIG. 17A, along with FIGS. 17B and 17C, are schematic in nature for purposes of illustration and are not drawn to scale. The value of W is preferably about ⅜ of an inch, and should be at least 1/16 of an inch.

FIG. 17B, which generally corresponds to FIG. 14D of the binding sequence, shows that stack 72 positioned on the adhesive sheet structure 86B, with the minor release liner 94B removed. Although not shown in FIG. 17B due to the exaggerated thickness of release liner 90B, after the user has pressed down on the edge of stack 72, as shown in FIG. 14D, the stack will come into contact that portion of the exposed pressure sensitive adhesive 92B above cover board 76B, thereby attaching the stack to the hard cover section 74B with the proper orientation. As previously noted, in order to provide access to the major release liner 90B, it is preferred that the user lift, that is fold up, only the outer edge of the stack 72, as shown in FIG. 14E, with the spine region of the stack remaining relatively horizontal. However, there is a tendency to rotate the stack 72 as shown in FIG. 17C, with such rotation tending to cause the stack to separate from the exposed adhesive 92B thereby disrupting the position of the stack relative to the hard cover section 74B.

Figure 18:
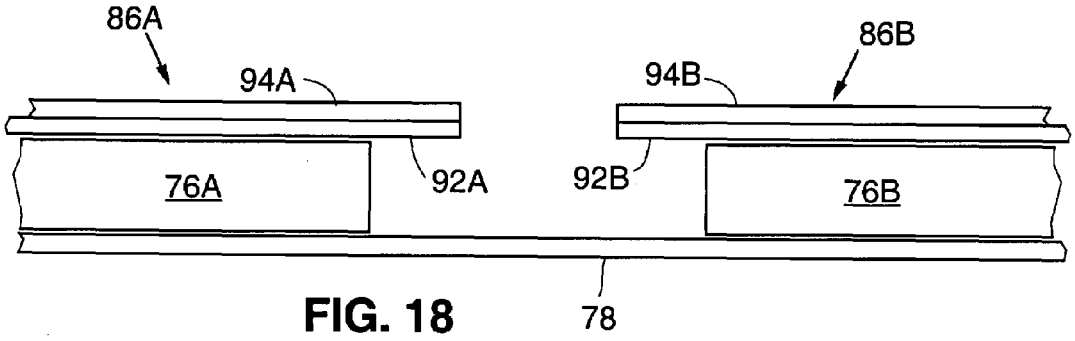
FIG. 18 depicts the further embodiment of the hardcover assembly.

As can be seen in FIG. 17C, such rotation will cause the stack to come into contact with the cantilevered portion of exposed adhesive 92B, that portion having dimension W in FIG. 17A. Although the adhesive 92B is supported in this region only by the rigidity of sheet 88B, the adhesive is sufficiently aggressive to cause the stack to adhere when rotation takes place. This action is adequate to keep the stack 72 sufficiently secured to the hard cover section 74B so as to maintain the desired orientation when the user is removing the major release liner 90B as shown in FIG. 14E. For hard cover assemblies where the hard cover sections 74A and 74B are interchangeable (either section could be the front or back book cover), it is preferable to provide both the extension of sheet 88B and adhesive 92B shown in FIG. 17A for sheet structure 86B and a corresponding extension for sheet 88A and adhesive 92A for sheet structure 86A, as shown in FIG. 18 (the bottom sheets 88A and 88B are not shown in FIG. 18).

Figure 19:
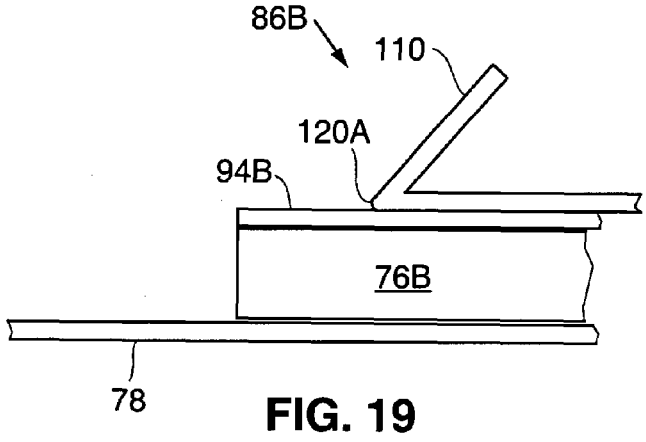
FIG. 19 depicts a still further variation of the hardcover assembly.
Figure 20:
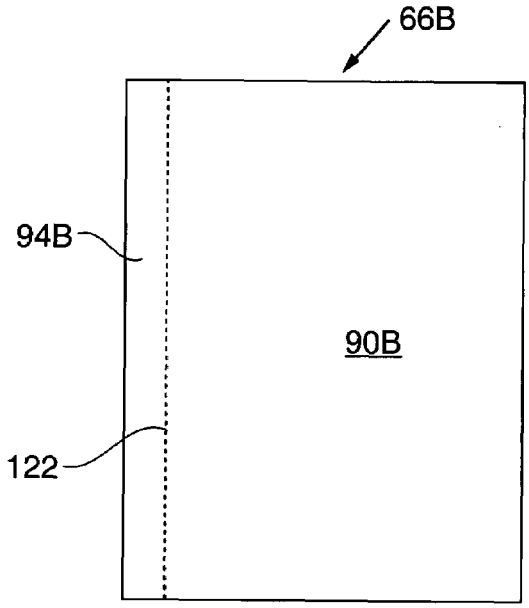
FIG. 20 shows a variation of the release liners used in the hardcover assembly.

It would be possible to have major and minor release liners, such as liners 90B and 94B, formed from one sheet but separated by perforations 122 as shown in FIG. 20. A user would then separate the minor release liner 94B from the major release liner 90B by simply tearing the sheet along the perforations. In addition, it would be possible to use a single release liner for each respective cover section 74A and 74B which covered the entire surface of the pressure sensitive adhesive 92A and 92B. FIG. 19 shows, in schematic form, the single release liner 110 as part of adhesive sheet structure 86B (the bottom sheet 88B is not shown). At the step which corresponds to FIG. 14B, the user folds the release liner 110 at fold line 120A over on itself to expose a narrow strip of adhesive 92B near the spine. The user then places the stack 72 on the folded release liner, similar to the step shown in FIG. 14C and forces the stack 72 down on the exposed adhesive, similar to the step shown in FIG. 14D. The stack 72 is then resting on the exposed adhesive and the folded release liner 110. The user then lifts the edge of the stack and removes the folded release liner 110 in a manner similar to the removal of liner 90B shown in FIG. 14E. A similar folding step can be carried out in connection with the step shown in FIG. 14H in connection with release liner 90A. This approach is not preferred since the user has to carry out the additional folding steps.

Figure 21:
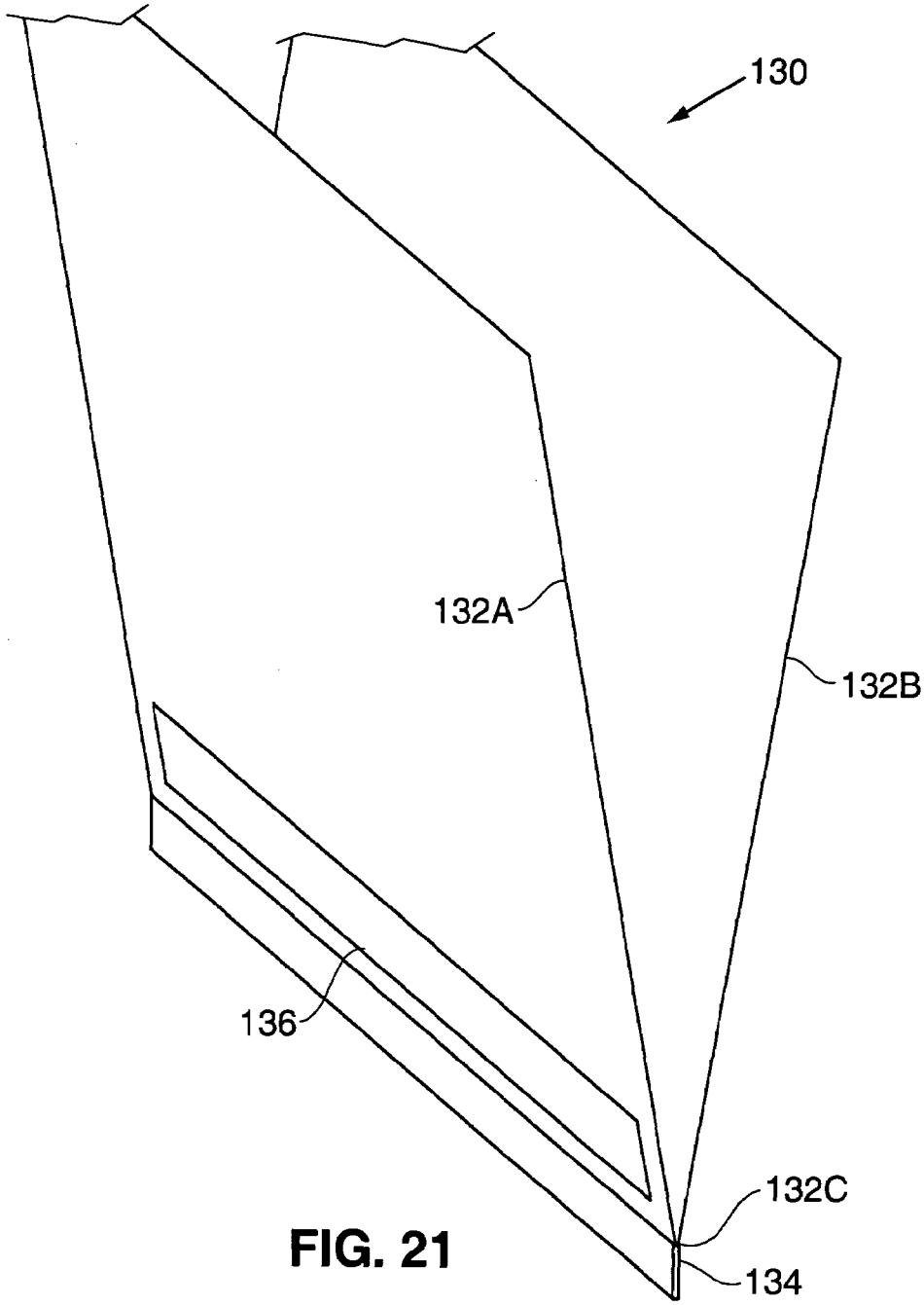
FIG. 21 is a perspective elevational view of an end leaf in accordance with one embodiment of the present invention.

A second embodiment book binding apparatus and related method will now be described. Referring again to the drawings, FIG. 21 shows an end leaf 130, in accordance with one embodiment of the invention, which includes sheets 132A and 132B, with the sheets defining an intermediate fold 132C. A spacer member 134 is secured to sheets 132A and 132B and extends past the fold. A strip of pressure sensitive adhesive is disposed on sheet 132A and extends along the length of the sheet proximate and parallel to fold 132C. A release liner 136 is disposed over the pressure sensitive adhesive.

Figure 22:
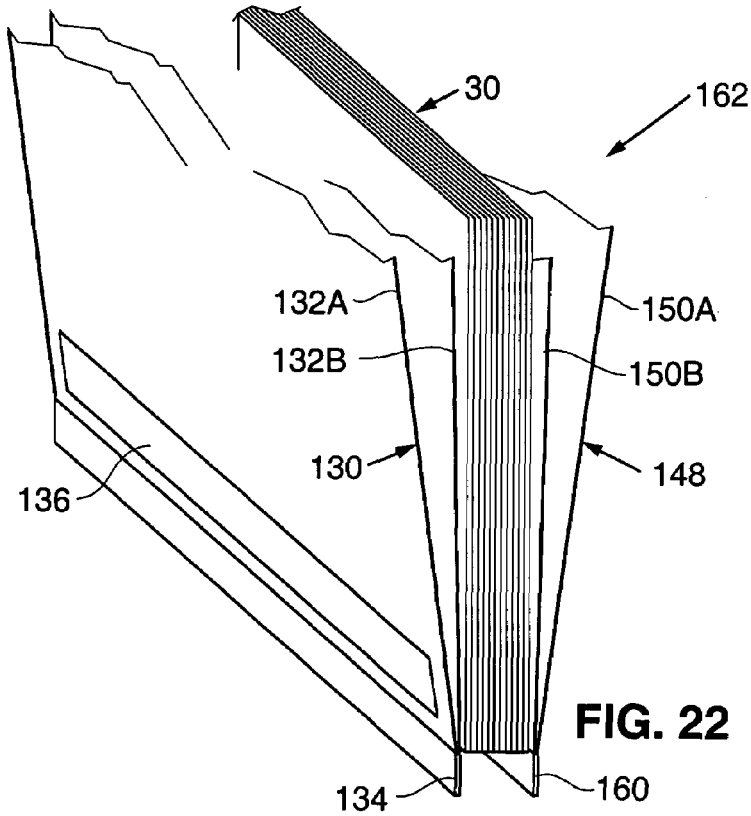
FIG. 22 is a perspective elevational view of a stack of sheets and two end leafs in accordance with one embodiment of the present invention.

As shown in FIG. 22, end leaf 130 and a second similar end leaf 148 are disposed on opposite sides of a stack 30 to be bound, as represented by element 58 of the FIG. 4 flow chart, to form assembly 162. The end leafs are positioned with the pressure sensitive adhesives and respective release liners facing outward. The assembly 162 is then preferably placed in a conventional perfect binder machine so that the lower edge of the stack will be ground, as represented by block 60 of the flow chart. The two spacer members 134 and 160 prevent the respective end leafs 130 and 148 to be damaged during the grinding step.

Figure 23A:
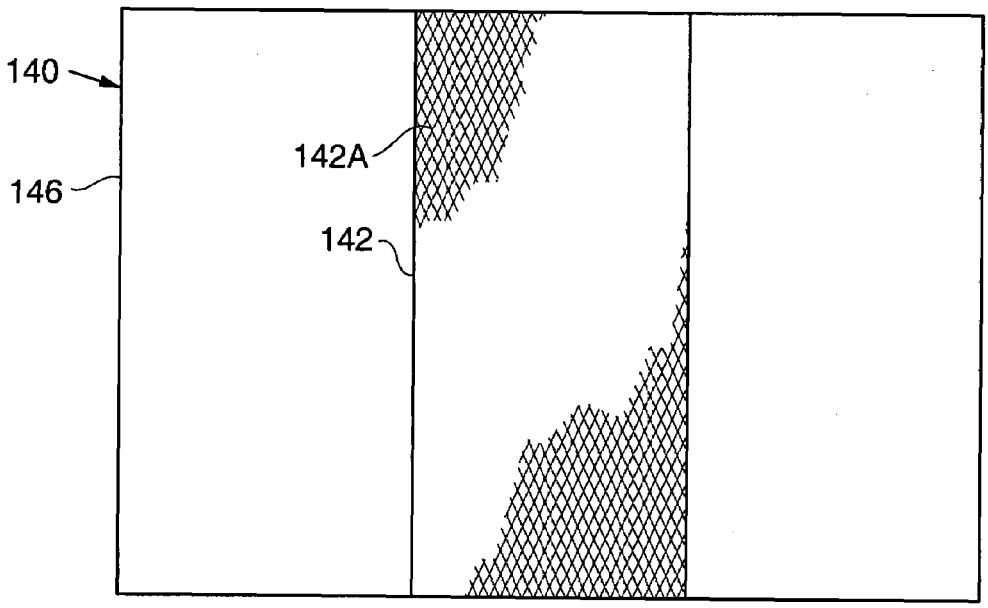
FIGS. 23A and 23B are respective plan and elevational views of another embodiment spine support structure.
Figure 23B:
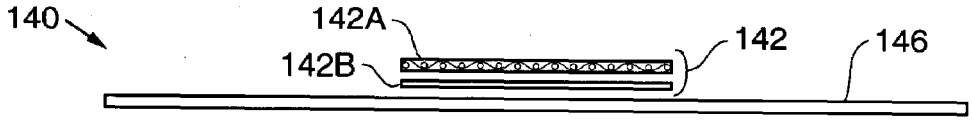

Referring to FIGS. 23A and 23B, an alternative embodiment spine support structure 140 may be seen. Structure 130 includes a spine member 142 disposed over a release sheet 146. Spine member 142 includes a mesh layer 142A and a substrate layer 142B disposed between the mesh layer and the release sheet. Spine member has a length equal to the length of the stack to be bound and a width substantially greater than the thickest stack to be bound, typically about 4 inches. The release sheet can be made of the same material used for release sheets 52A and 52B of the first embodiment. Mesh layer 142A is a cloth mesh, typically having a thread count of 24×20 per square inch, of the type frequently used as a reinforcing material in book manufacturing and repair. The open mesh structure allows molten hot melt adhesive to pass through the structure. The substrate layer 142B can be a very thin layer of pressure sensitive or hot melt adhesive, the function of which is to tack mesh layer 142A down to release sheet 146. An adhesive found suitable for this application is sold by HB Fuller under the designation HM 1330.

Figure 24:
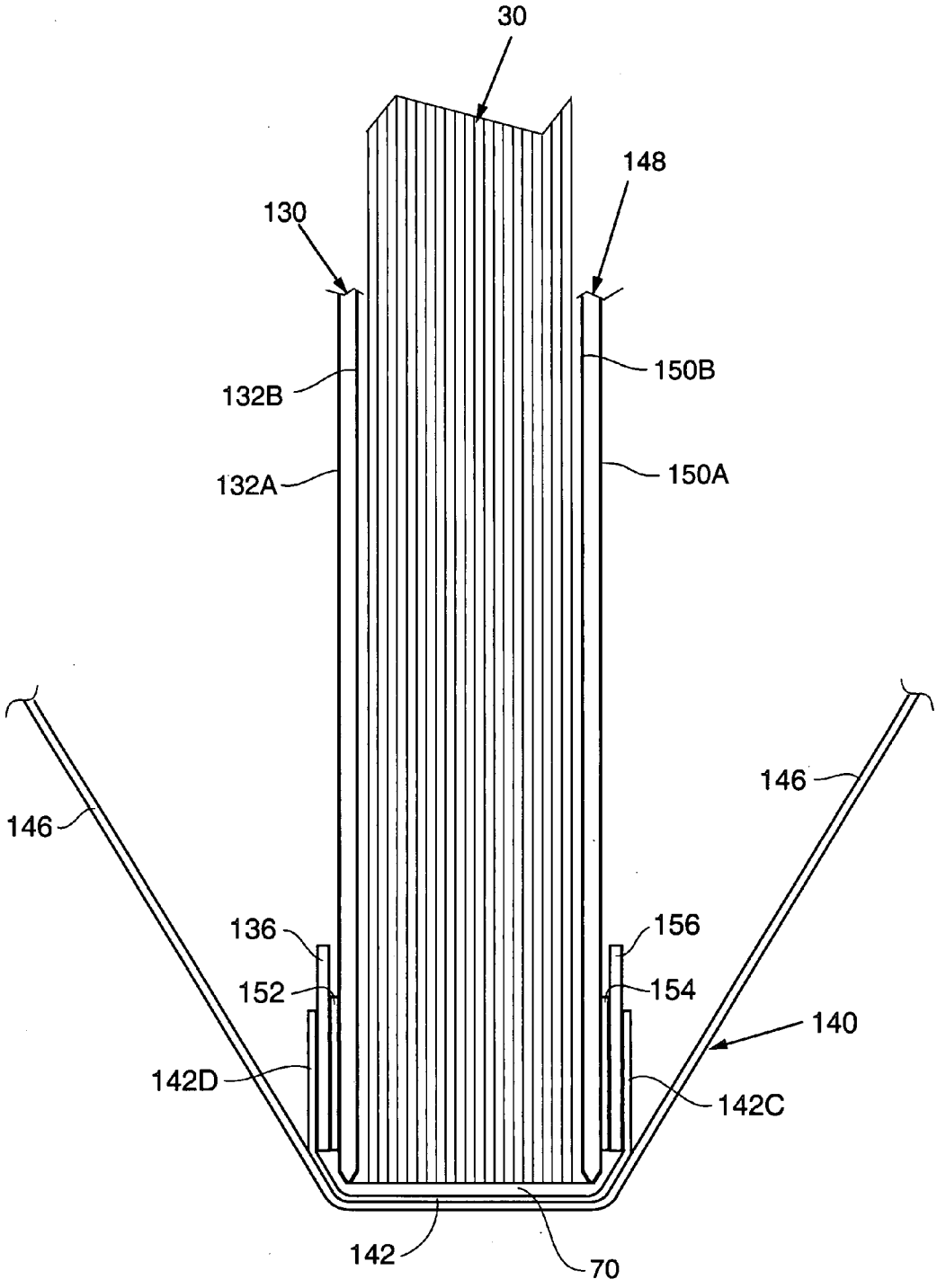
FIG. 24 is an elevational view of a bound stack using the spine support structure of FIGS. 23A and 23B.

Spine support structure 140, like structure 50 of the first embodiment, has a form factor in terms of overall length and width of the typical conventional cover used in perfect binder machines. Thus, spine support structure 140 can be manipulated by the binder machine in the same manner as a conventional cover. As indicated by element 64 of the FIG. 4 flow chart, the spine support structure 140 is wrapped around the edge of assembly 162 while the hot melt adhesive is still molten. This step is preferably carried out by the perfect binder machine. The hot melt adhesive 70 will operate to bind the edges of the stack 30 together, with the mesh layer being embedded in the adhesive and functioning to reinforce the adhesive. FIG. 24 shows the resultant structure, with the outer portions of release sheet 146 being folded away from the stack from purposes of illustration. Although adhesive 70 will secure the spine member 142 to the edge of the stack 30, the adhesive will not fully secure the spine member supper sections 142C and 142D to either end leaf 130 or end leaf 148.

Figure 25:
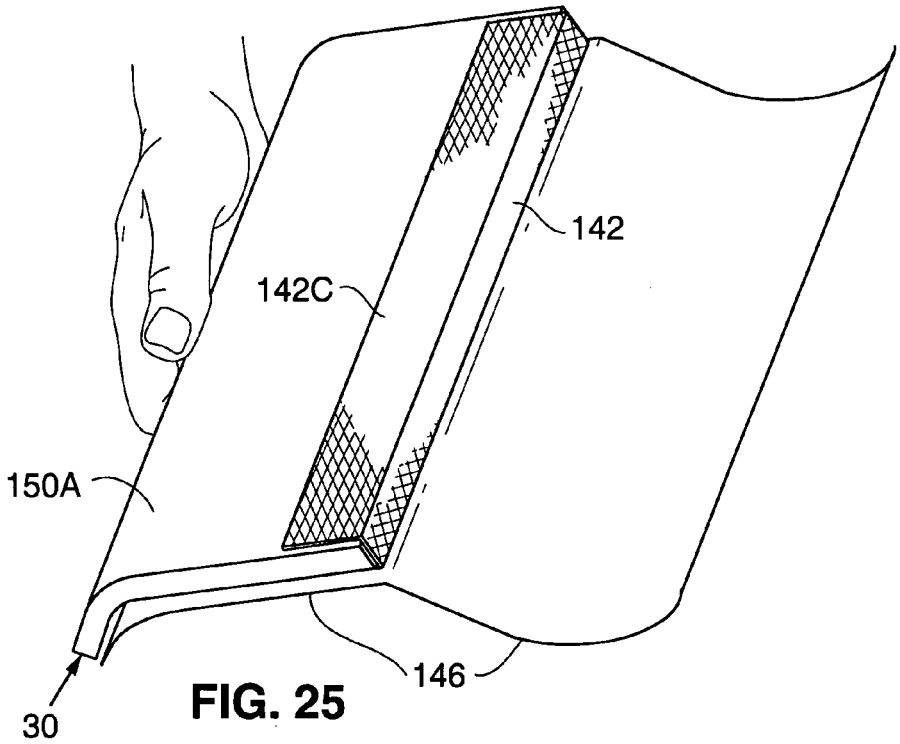
FIG. 25 depicts the step of removing the release sheet of the spine support structure from the bound book.
Figure 26:
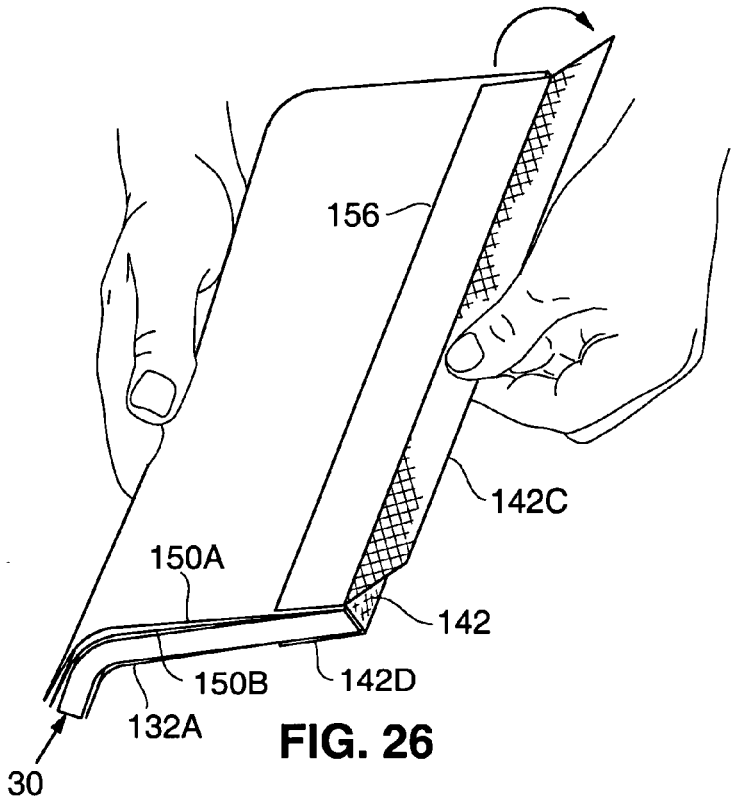
FIG. 26 depicts the step of exposing a release liner by folding a portion of the spine support structure away from the bound stack.
Figure 27:
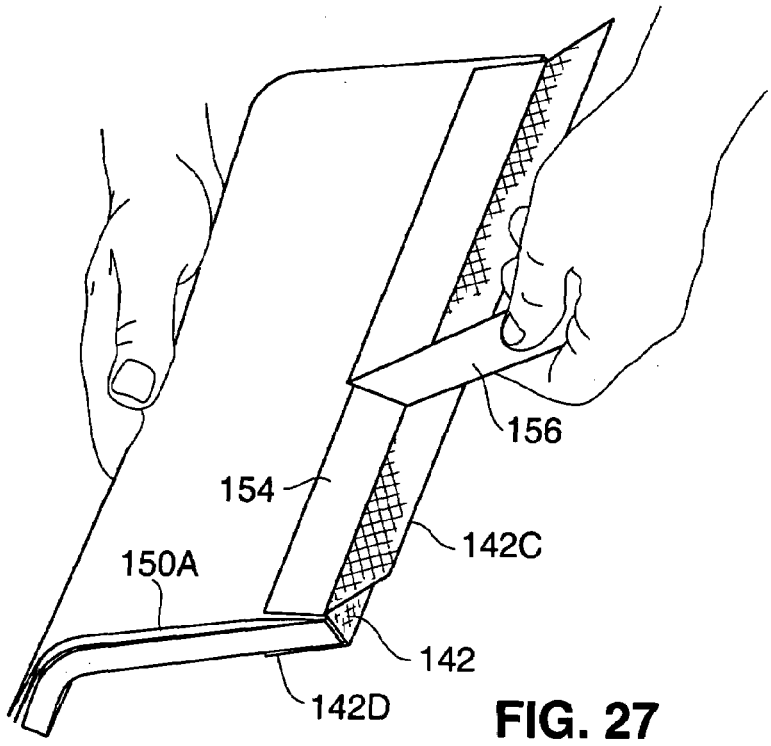
FIG. 27 depicts the step of removing the release liner so as to expose the underlying pressure sensitive adhesive.
Figure 28:
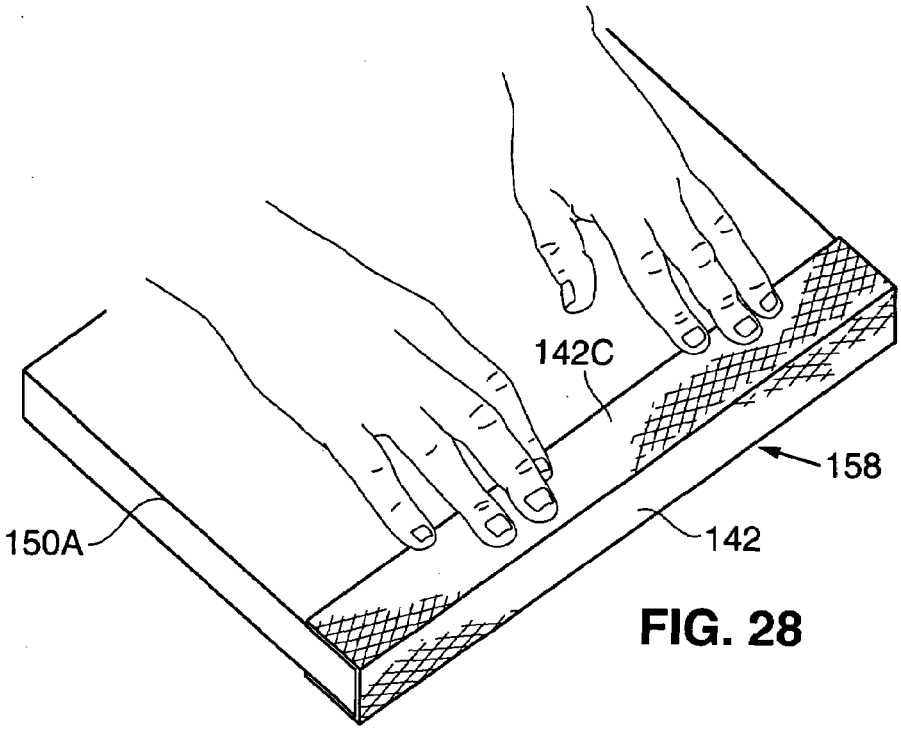
FIG. 28 depicts the step of securing an edge of the spine member to the stack by pressing the edge against the underlying pressure sensitive adhesive.

Referring now to FIG. 25, once the hot melt adhesive has cooled, the user manually separates the release sheet 146 from the bound stack. The composition of the release sheet 146 permits this separation without damage to the underlying spine member 142. The user then folds upper sections 142C and 142D away from the stack as shown in FIG. 26 so as to expose the underlying release liners 156 and 136. Release liner 156 is then peeled away so as to expose the underlying pressure sensitive adhesive 154 as shown in FIG. 27 and as represented by element 66 of the FIG. 4 flow chart. Next, the upper section 142C of the spine member 142 is folded back over adhesive 154 and pressed down as illustrated in FIG. 28. This secures section 142C to sheet 150A of the end leaf. A similar process is carried out in connection with upper section 142D, with release liner 136 being removed so that section 142D can be secured to sheet 132A of the other end leaf by way of pressure sensitive adhesive 152. This results in bound book 158 (FIG. 28).

The user can then apply a hardcover assembly 74 as shown in FIG. 9 and as represented by element 68 of the FIG. 4 flow chart. As previously described in connection with FIGS. 14A through 14M, sheets 150A and 132A of the end leafs of the book 162 are sequentially secured to the hard cover sections 74A and 74B in the same manner as sheets 40A and 40B of the first embodiment bound book 72. Again, it is important to note that spine member 142 is securely attached to the stack or book block 30 by way of hot melt adhesive 70. In turn, the end leafs 130 and 148 are secured to the book block 30 by way of the spine member 142, with the mesh layer 142A acting to reinforce the strength of the structure. Finally, the hardcover assembly 74 is secured to the book by way of end leafs 130 and 148. As was the case with the earlier described embodiment, any interface between a hot melt adhesive and a cold glue, an interface which tends to fail over time, is avoided.

Thus, various embodiments of a novel book binding apparatus and related binding methods have been disclosed. Although these embodiments have been described in some detail, it is to be understood that various changes can be made by those skilled in the art without departing from the spirit and scope of the invention as defined by the appended claims.

The invention claimed is:

1. A method of binding a stack of sheets comprising: providing first and second end leafs, with each end leaf including first and second sheet segments separated by a fold, with each sheet segment having dimensions that generally correspond to dimensions of the sheets of the stack of sheets; providing first and second segments of pressure sensitive adhesives, with each of the segments of pressure sensitive adhesives having a covered surface;

disposing the stack of sheets intermediate the first and second end leafs, with the folds of the end leafs being positioned proximate an edge of the stack to be bound and with the second sheet segments of the first and second end leafs being positioned adjacent the stack;

applying molten hot melt adhesive to the edge of the stack and to the first and second end leafs;

securing an elongated spine member to the edge of the stack by way of the molten hot melt adhesive;

exposing the covered surface of each of the first and second segments of pressure sensitive adhesive subsequent to the securing;

attaching a first edge of the elongated spine member to the first sheet segment of the first end leaf by way of the first segment of pressure sensitive adhesive; and attaching a second edge of the elongated spine member, opposite the first edge, to the first sheet segment of the second end leaf by way of the second segment of the pressure sensitive adhesive.

2. The method of claim 1 further comprising:

providing a hard cover assembly including first and second relatively rigid hardcover sections separated by a spine segment, with the first hardcover section including a first pressure sensitive adhesive layer and with the second hardcover section including a second pressure sensitive adhesive layer;

attaching the first hardcover section to the first sheet segment of the first end leaf by way of the first pressure sensitive adhesive layer; and attaching the second cover section to the first sheet segment of the second end leaf by way of the second pressure sensitive adhesive layer.

3. The method of claim 2 wherein the attaching the first hard cover section includes:

exposing only a portion of the first pressure sensitive adhesive layer to produce a first exposed portion of the first pressure sensitive adhesive layer;

bringing the first sheet segment of the first end leaf and the first exposed portion of the first pressure sensitive adhesive layer into contact with one another;

exposing a second portion of the first pressure sensitive adhesive layer so as to produce an exposed second portion of the first pressure sensitive adhesive layer; and bringing the first sheet segment of the first end leaf and the exposed second portion of the first layer of pressure sensitive adhesive layer into contact with one another.

4. The method of claim 1 wherein the first and second segments of pressure sensitive adhesive are disposed along the respective first and second edges of the elongated spine member, with the first and second segments of pressure sensitive adhesive being covered by respective first and second release liners and wherein the securing includes wrapping the spine member around the edge of the stack and wherein the exposing includes separating the first and second release liners from the first and second segments of pressure sensitive adhesive.

5. The method of claim 4 wherein the wrapping is carried out by a conventional binding machine of the type that wraps a conventional cover around a stack of sheets and wherein the elongated spine member and the first and second release liners are embodied in a configuration having a form factor of the conventional cover.

6. The method of claim 5 wherein the sheets of the stack have a length and a width and the configuration form factor has one dimension that generally corresponds the length and a second dimension that generally corresponds to at least twice the width.

7. The method of claim 1 wherein the first segment of pressure sensitive adhesive is disposed on the first end leaf and the second segment of pressure sensitive adhesive is disposed on the second end leaf, with the first and second segments of pressure sensitive adhesive being covered by release liners and wherein the exposing includes separating the first and second release liners from the first and second segments of pressure sensitive adhesive.

8. The method of claim 7 wherein the securing the elongated spine member includes wrapping the spine member around the edge of the stack and wherein the wrapping is carried out by a conventional binding machine of the type that wraps a conventional cover around a stack of sheets and wherein the elongated spine member and the first and second release liners are embodied in a configuration having a form factor of a conventional cover.

9. The method of claim 8 wherein the sheets of the stack have a length and a width and the configuration form factor has one dimension that generally corresponds the length and a second dimension that generally corresponds to at least twice the width.

10. A method of binding a stack of sheets comprising:

providing first and second end leafs, with each end leaf including first and second sheet segments separated by a fold, with each sheet segment having dimensions that generally correspond to dimensions of the sheets of the stack of sheets;

providing first and second segments of pressure sensitive adhesive, with the first and second segments of pressure sensitive adhesive each having a first surface covered by respective first and second release liners;

disposing the stack of sheets intermediate the first and second end leafs, with the folds of the end leafs being positioned proximate an edge of the stack to be bound and with the second sheet segments of the first and second end leafs being positioned adjacent the stack;

subsequent to the disposing, applying molten hot melt adhesive to the edge of the stack;

securing an elongated spine member to the edge of the stack by way of the molten hot melt adhesive;

subsequent to the securing, removing the first release liner thereby exposing the first surface of the first segment of pressure sensitive adhesive and then attaching a first edge of the elongated spine member to the first end leaf by way of the first segment of pressure sensitive adhesive so that the fold of the first end leaf is disposed intermediate the first edge of the elongated spine member and the stack of sheets; and subsequent to the securing, removing the second release liner thereby exposing the first surface of the second segment of pressure sensitive adhesive and then attaching a second edge, opposite the first edge, of the elongated spine member to the second end leaf by way of the second segment of pressure sensitive adhesive so that the fold of the second end leaf is disposed intermediate the second edge of the elongated spine member and the stack of sheets.

11. The method of claim 10 wherein the providing first and second segments of pressure sensitive adhesive includes securing a second surface, opposite the first surface, of the first segment of pressure sensitive adhesive to the first sheet segment of the first end leaf and securing a second surface, opposite the first surface, of the second segment of pressure sensitive adhesive to the first sheet segment of the second end leaf.

12. The method of claim 10 wherein the providing first and second segments of pressure sensitive adhesive includes securing a second surface, opposite the first surface, of the first segment of pressure sensitive adhesive to the elongated spine member adjacent the first edge of the elongated spine member and securing a second surface, opposite the first surface, of the second segment of pressure sensitive adhesive to the elongated spine member adjacent the second edge of the elongated spine member.

* * * * *